US010914296B2

(12) United States Patent
Her et al.

(10) Patent No.: US 10,914,296 B2
(45) Date of Patent: Feb. 9, 2021

(54) MOTOR OPERATED COMPRESSOR

(71) Applicant: LG ELECTRONICS INC., Seoul (KR)

(72) Inventors: Jongtae Her, Seoul (KR); Dongwoo Min, Seoul (KR); Byeongchul Lee, Seoul (KR); Kitae Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/528,734

(22) Filed: Aug. 1, 2019

(65) Prior Publication Data

US 2020/0072203 A1 Mar. 5, 2020

(30) Foreign Application Priority Data

Aug. 31, 2018 (KR) ..... 10-2018-0103848

(51) Int. Cl.

| | |
|---|---|
| ***F04C 29/00*** | (2006.01) |
| ***F04C 18/02*** | (2006.01) |
| ***F04B 17/03*** | (2006.01) |
| ***F04C 23/02*** | (2006.01) |

(52) U.S. Cl.

CPC ..... *F04B 17/03* (2013.01); *F04C 18/02* (2013.01); *F04C 23/02* (2013.01); *F04C 29/0057* (2013.01)

(58) Field of Classification Search

CPC ... F04C 18/0215; F04C 18/0261; F04C 29/12
See application file for complete search history.

(56) References Cited

U.S. PATENT DOCUMENTS 6,030,192 A * 2/2000 Hill ..... F04C 18/0215 418/55.2
9,157,438 B2 * 10/2015 Seong ..... F04C 18/0246
9,175,683 B2 11/2015 Unami et al.
(Continued)

FOREIGN PATENT DOCUMENTS

JP H0754784 A 2/1995
JP H07259771 A 10/1995
(Continued)

OTHER PUBLICATIONS

European Search Report dated Jan. 27, 2020.

*Primary Examiner* — Patrick Hamo
(74) *Attorney, Agent, or Firm* — Finnegan, Henderson, Farabow, Garrett & Dunner LLP

(57) ABSTRACT

A motor operated compressor includes a drive motor and a rotary shaft coupled to the rotor. A first scroll disposed on one side of the drive motor is eccentrically coupled to and orbitally moved by the rotary shaft. A second scroll faces the first scroll and is coupled to the first scroll to form a compression chamber. A hollow portion is formed inside the rotary shaft along an axial direction, and an eccentric portion having a rotary shaft side discharge hole extends from the rotary shaft center to a rotary shaft outer circumferential surface. The first scroll includes a rotary shaft coupling portion surrounding an outer circumferential surface of the eccentric portion. The rotary shaft coupling portion is provided with a first scroll side discharge hole formed at a position periodically facing the rotary shaft side discharge hole to discharge compressed fluid to the rotary shaft side discharge hole.

15 Claims, 12 Drawing Sheets

(56) References Cited

U.S. PATENT DOCUMENTS

| | | | | |
|---|---|---|---|---|
| 9,879,679 | B2 * | 1/2018 | Lee | F04C 18/0215 |
| 2019/0360490 | A1 * | 11/2019 | Lee | F04C 23/008 |

FOREIGN PATENT DOCUMENTS

| | | | |
|---|---|---|---|
| JP | 2002180978 | A | 6/2002 |
| JP | 2005264827 | A | 9/2005 |
| JP | 2009-250127 | | 10/2009 |
| WO | WO 96/20345 | | 7/1996 |

* cited by examiner

MOTOR OPERATED COMPRESSOR

CROSS-REFERENCE TO RELATED APPLICATIONS

The present disclosure relates to subject matter contained in priority Korean Application No. 10-2018-0103848, filed on Aug. 31, 2018, which is herein expressly incorporated by reference in its entirety.

BACKGROUND OF THE DISCLOSURE

1. Field of the Disclosure

The present disclosure relates to a motor operated compressor driven by a motor.

2. Description of the Conventional Art

As a motor operated compressor, a scroll compression method suitable for a high compression ratio operation is widely known. An electric motor unit composed of a drive motor is installed within a sealed casing of a scroll compression type motor operated compressor (hereinafter, abbreviated as a motor operated compressor in this specification). Furthermore, a compression unit including a fixed scroll and an orbiting scroll is provided on one side of the electric motor unit. The electric motor unit and the compression unit are connected to the rotary shaft. A rotational force of the electric motor unit is transmitted to the compression unit through the rotary shaft. Furthermore, the compression unit compresses fluid such as refrigerant by a rotational force transmitted through the rotary shaft.

One of the various factors that determine the performance of a scroll compressor is the configuration of passages. The passages of the scroll compressor may be divided into a suction passage and a discharge passage with respect to the compression unit. In particular, since the discharge passage is to discharge high-pressure fluid, a more precise design should be made as compared with the suction passage.

A scroll compressor is disclosed in Japanese Patent Application Laid-Open No. 2009-250127 (Oct. 29, 2009), which is a prior art document. The scroll compressor disclosed in the prior art document includes an introduction hole 20 that is open toward a discharge chamber on a side of a scroll mechanism 4 and a flow hole 21 formed on a rotary plate 14. The introduction hole 20 and the flow hole 21 repeat communication and non-communication according to the rotation of the rotary plate 14. Compressed fluid is discharged to the discharge chamber 13 at a position where the introduction hole 20 and the flow hole 21 are communicated with each other.

However, in this structure, the compressed fluid must primarily pass through a gap of an eccentric bush 16 at a central portion of the scroll mechanism 4, and secondarily pass through the flow hole 21 and the introduction hole 20 again by changing the direction of flow. Accordingly, the flow resistance is excessively generated until the compressed fluid is discharged to the discharge port 12, which causes the efficiency of the scroll compressor to be reduced.

A scroll compressor is also disclosed in US Patent Application Publication US2018/0073505A1 (Mar. 23, 2015), which is another prior art document. The scroll compressor disclosed in the prior art document is configured to discharge compressed refrigerant through a plurality of discharge ports 325a, 325b and a plurality of bypass holes 381, 382 formed in a disk portion 321 of a first scroll.

However, in this structure, the number of the discharge ports 325a, 325b and the number of the bypass holes 381, 382 are excessively large, which is a cause of complicating the structure of the scroll compressor. Furthermore, valves 383a, 383b must be provided for each of the plurality of discharge ports 325a, 325b and for each of the plurality of bypass holes 381, 382 through it is disadvantageous for simplification and downsizing of the scroll compressor. Moreover, it may result in difficulty in designing an optimal structure such as the number, position, size, separation distance or the like of bypass holes.

As described above, the scroll compressor in the related art is disadvantageous in terms of complicated structure, excessive flow resistance, compression efficiency deterioration, simplification and downsizing, and has limitations such as difficulty in designing an optimum structure, and the like.

(Patent Document 1) Japanese Patent Application Laid-Open No. 2009-250127 (Oct. 29, 2009)

(Patent Document 2) US Patent Application Publication US2018/0073505A1 (Mar. 15, 2018.)

SUMMARY OF THE DISCLOSURE

The present disclosure is to propose a motor operated compressor having a structure capable of solving a problem of causing excessive flow resistance or causing compression efficiency deterioration due to a complicated passage configuration in the related art. In particular, the present disclosure is to propose a motor operated compressor having a simple discharge passage through a structure capable of discharging high-pressure refrigerant through a hollow portion of a rotary shaft, thereby relieving flow resistance and preventing compression efficiency deterioration.

The present disclosure is to propose a motor operated compressor having a structure in which a plurality of discharge ports and a plurality of bypass holes are formed in a scroll in the related art, thereby solving a problem that a discharge valve must be provided for each port and each hole. In particular, the present disclosure is to provide a structure which is advantageous for simplification, downsizing, and optimum structure design of a compressor structure since high-pressure refrigerant can be discharged by only at least one discharge hole formed in a rotary shaft. Furthermore, the present disclosure is to provide a motor operated compressor having a structure in which no reverse flow of refrigerant does not occur even without a discharge valve.

In order to achieve an object of the present disclosure, a motor operated compressor according to an embodiment of the present disclosure may have a discharge passage formed by a hollow portion of a rotary shaft.

The rotary shaft may include a hollow portion and an eccentric portion. The hollow portion may be formed along an axial direction inside the rotary shaft. The eccentric portion may be eccentrically formed from the center of the rotary shaft, and may have a rotary shaft side discharge hole communicated from an outer circumferential surface to the hollow portion.

The motor operated compressor may include a first scroll and a second scroll. The first scroll may be eccentrically coupled to the rotary shaft, and orbitally moved by the rotary shaft. The second scroll may be fixed at a position facing the first scroll, and coupled to the first scroll to form a compression chamber together with the first scroll.

The first scroll may be provided with a rotary shaft coupling portion formed to surround an outer circumferential surface of the eccentric portion, and the rotary shaft coupling portion may be provided with a first scroll side discharge holes formed at positions periodically facing rotary shaft side discharge holes to discharge compressed fluid to the rotary shaft side discharge holes.

The motor operated compressor may include a drive motor having a stator and a rotor, and the rotary shaft may be coupled to the rotor.

According to an example associated with the present disclosure, the rotary shaft side discharge hole may have a long hole shape in which a curve length extended along an outer circumferential surface of the eccentric portion is greater than a curve or straight-line length extended along an axial direction of the rotary shaft.

According to another example associated with the present disclosure, an axial direction length of the rotary shaft side discharge hole may be constant, and a circumferential direction width of the rotary shaft side discharge hole may be formed to gradually increase from an inner circumferential surface of the hollow portion to an outer circumferential surface of the eccentric portion.

According to another example associated with the present disclosure, a cross section of the rotary shaft side discharge hole may have an annulus sector shape obtained by subtracting a smaller one from a larger one of two sectors having the same origin and the same central angle.

According to another example associated with the present disclosure, the eccentric portion may include a first portion having a relatively large thickness in a radial direction of the eccentric portion; and a second portion formed on both sides of the first portion to have a relatively small thickness in a radial direction of the eccentric portion, and the rotary shaft side discharge hole may be formed in the first portion.

According to another example associated with the present disclosure, when a reference point of a portion having the largest thickness in the eccentric portion with respect to the center of the rotary shaft is defined as 0° which is a reference of a circle coordinate, the rotary shaft side discharge hole may be formed in a range of −60° to +60°.

According to another example associated with the present disclosure, the rotary shaft side discharge holes may be formed in a plural number, and the plurality of rotary shaft side discharge holes may be formed at positions spaced apart from each other along an axial direction of the rotary shaft or formed at positions spaced apart from each other in a direction intersecting the axial direction along an outer circumferential surface of the eccentric portion According to another example associated with the present disclosure, the first scroll side discharge holes may be formed in a plural number, and the plurality of the first scroll side discharge holes may be formed at positions spaced apart from each other along an axial direction of the rotary shaft or formed at positions spaced apart from each other in a direction intersecting the axial direction along an inner circumferential surface of the rotary shaft coupling portion.

According to another example associated with the present disclosure, the first scroll may include a plate shaped disk portion; and a wrap protruded from the disk portion toward the second scroll along an involute shape, and the rotary shaft coupling portion may be formed at a position corresponding to a base circle in the involute shape, and the first scroll side discharge hole may be formed at a portion having the smallest radial direction thickness in the rotary shaft coupling portion.

According to another example associated with the present disclosure, a size of the first scroll side discharge hole may be smaller than that of the rotary shaft side discharge hole.

According to another example associated with the present disclosure, a circumferential direction width of the first scroll side discharge hole may be smaller than that of the rotary shaft side discharge hole.

According to another example associated with the present disclosure, the motor operated compressor may further include a bush bearing formed to surround the eccentric portion, wherein the bush bearing is disposed between the eccentric portion and the rotary shaft coupling portion, and provided with a bush bearing side discharge hole formed at a position facing the first scroll side discharge hole.

According to another example associated with the present disclosure, a relative position between the rotary shaft coupling portion and the bush bearing may be fixed to maintain a state in which the first scroll side discharge hole and the bush bearing side discharge hole face each other.

According to another example associated with the present disclosure, the second scroll may be disposed to face one end of the rotary shaft, and provided with a second scroll side discharge hole at a position facing the hollow portion.

According to another example associated with the present disclosure, the second scroll may have a shaft receiving portion, and the shaft receiving portion may be formed to be recessed on one surface of the second scroll to accommodate one end of the rotary shaft, and the rotary shaft may be inserted into the shaft receiving portion through the first scroll, and the second scroll side discharge hole may be formed in the shaft receiving portion.

According to another example associated with the present disclosure, the motor operated compressor may further include a discharge valve formed to open and close the second scroll side discharge hole, wherein the discharge valve is formed to be open above reference pressure.

According to another example associated with the present disclosure, the motor operated compressor may further include a rear housing, wherein the rear housing is coupled to the second scroll to form an oil separation chamber that accommodates fluid discharged through the second scroll side discharge hole, and the second scroll includes a plate shaped disk portion; and an oil guide passage passing through the disk portion to supply oil stored in the oil separation chamber to an outer circumferential surface of the rotary shaft.

According to another example associated with the present disclosure, the motor operated compressor may further include a main frame formed to support the first scroll, wherein the main frame, the first scroll, and the second scroll are sequentially arranged along a direction away from the drive motor, and the rotary shaft is extended to a position facing a disk portion of the second scroll through the main frame and the first scroll, and the second scroll side discharge hole is formed in the disk portion.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION OF THE PREFERRED EMBODIMENT

Figure 1:
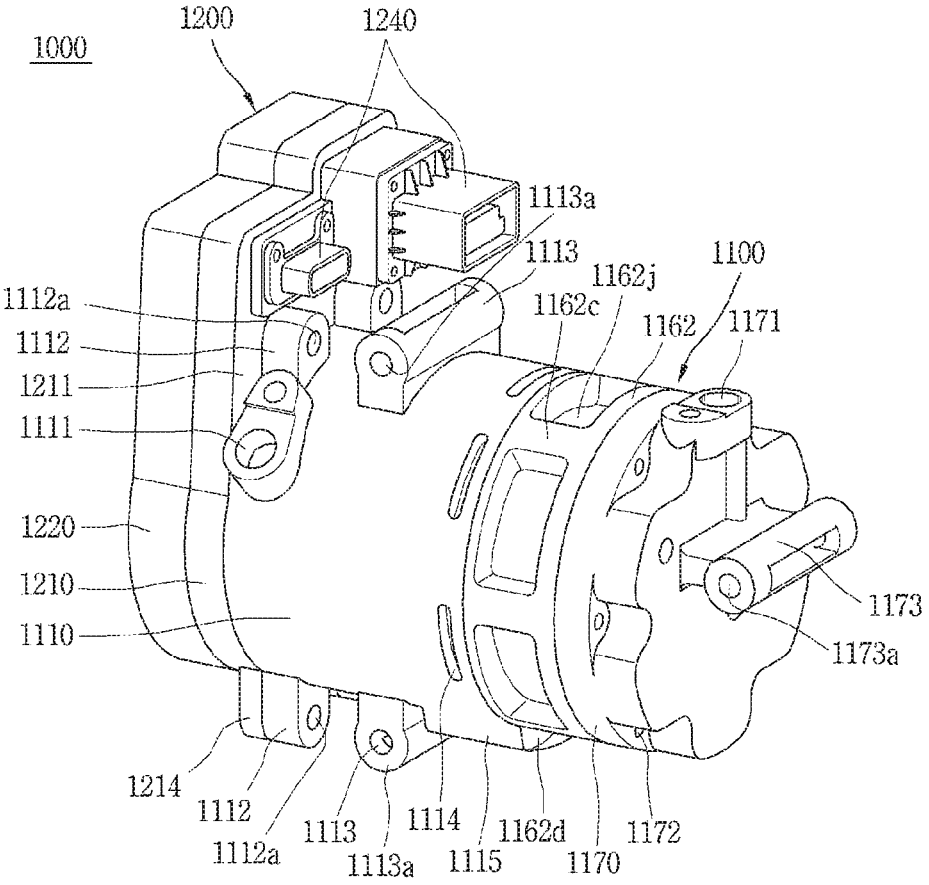
FIG. 1 is a perspective view showing an appearance of a motor operated compressor provided in the present disclosure.

Hereinafter, an electromotive compressor associated with the present disclosure will be described in detail with reference to the accompanying drawings.

Even in different embodiments according to the present disclosure, the same or similar reference numerals are designated to the same or similar configurations, and the description thereof will be substituted by the earlier description.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

A singular representation used in the present specification may include a plural representation as far as it represents a definitely different meaning from the context.

FIG. 1 is a perspective view showing an appearance of a motor operated compressor 1000 provided in the present disclosure.

The motor operated compressor 1000 includes a compressor module 1100 and an inverter module 1200.

The compressor module 1100 refers to a set of components for compressing fluid such as refrigerant. The inverter module 1200 refers to a set of components for controlling the driving of the compressor module 1100. The inverter module 1200 may be coupled to one side of the compressor module 1100. When directivity is set based on the flow of fluid compressed by the motor operated compressor 1000, one side of the compressor module 1100 refers to a front side of the compressor module 1100. The fluid is introduced into an intake port 1111 and discharged to a discharge port 1171, and thus the inverter module 1200 disposed close to the intake port 1111 may be described as being coupled to the front side of the compressor module 1100.

The appearance of the compressor module 1100 may be formed by a main housing 1110, a second scroll 1162, and a rear housing 1170.

The main housing 1110 has a hollow cylindrical shape, a polygonal column, or a similar appearance thereto. The main housing 1110 may be disposed to extend transversely with respect to the ground. Both ends of the main housing 1110 may be entirely or partially open. Specifically, a front end of the main housing 1110 is open, and a rear end of the main housing 1110 is partially open.

An intake port 1111, a main housing side fastening portion 1112, a main housing side fixing portion 1113, and the like are formed on an outer circumferential surface of the main housing 1110.

The intake port 1111 forms a passage for supplying fluid subject to compression to an inner space of the motor operated compressor 1000. The intake port 1111 may be protruded from an outer circumferential surface of the main housing 1110. The intake port 1111 may be connected to a suction pipe (not shown) for supplying fluid subject to compression to the motor operated compressor 1000. The intake port 1111 has a shape corresponding to the suction pipe to be coupled to the suction pipe.

A main housing side fastening portion 1112 is a structure for coupling the compressor module 1100 to the inverter module 1200. The main housing side fastening portion 1112 may be protruded from an outer circumferential surface of the main housing 1110. A plurality of main housing side fastening portions 1112 may be formed along an outer circumferential surface of the main housing 1110. The plurality of main housing side fastening portions 1112 may be arranged to be spaced apart from each other. A fastening hole 1112*a* for fastening a bolt is formed on the main housing side fastening portion 1112. The main housing side fastening portion 1112 may be bolt-fastened to an inverter housing 1210 of the inverter module 1200 through the fastening hole 1112*a* or bolt-fastened to an inverter housing side fastening portion 1214 formed on the inverter housing 1210.

The main housing side fixing portion 1113 is a structure for fixing the motor operated compressor 1000. The main housing side fixing portion 1113 may be protruded from an outer circumferential surface of the main housing 1110. The main housing side fixing portion 1113 may extended along an outer circumferential surface of the main housing 1110. The main housing side fixing portion 1113 may have a fixing hole 1113*a* capable of coupling to any fastening member. The fixing hole 1113*a* may be open toward a direction intersecting an axial direction of a rotary shaft 1130 (see FIG. 3) which will be described later. Here, the axial direction denotes an extension direction of the rotary shaft 1130. The main housing side fixing portions 1113 may be formed on one side and the other side of the main housing 1110, respectively. For instance, in FIG. 1, the main housing side fixing portions 1113 are formed above and below the main housing 1110, respectively.

A slit groove 1114 may be formed on an outer circumferential surface of the main housing 1110. A plurality of slit grooves 1114 may be formed along an outer circumferential surface of the main housing 1110. The plurality of slit grooves 1114 may be arranged to be spaced apart from each other. The slit grooves 1114 serve to reduce the weight of the main housing 1110.

A first protruding portion 1115 may be formed on an outer circumferential surface of the main housing 1110. The first protruding portion 1115 may be extended along an axial direction or a direction parallel to the axial direction on an outer circumferential surface of the main housing 1110. A first passage 1115*a* (see FIG. 3) communicating with the motor chamber (S1) (see FIG. 2) may be formed inside the first protruding portion 1115.

The second scroll 1162 is provided on the other side of the main housing 1110 or on a rear side of the main housing 1110. The sidewall portion 1162*c* of the second scroll 1162 may be formed to correspond to an outer circumferential surface of the main housing 1110. The second scroll 1162 may be provided inside the main housing 1110 as illustrated in FIG. 1.

A slit groove 1162*j* may also be formed on an outer circumferential surface of the second scroll 1162 similarly to the main housing 1110. A plurality of slit grooves 1162*j* may be formed on an outer circumferential surface of the second scroll 1162. The plurality of slit grooves 1162*j* may be arranged to be spaced apart from each other. The slit grooves 1162*j* serve to reduce the weight of the second scroll 1162.

The rear housing 1170 is provided on the other side of the second scroll 1162 or on a rear side of the second scroll 1162. The rear housing 1170 may be formed to cover the rear side of the second scroll 1162.

The rear housing 1170 includes a discharge port 1171, a fastening hole 1172, and a fixing portion 1173.

The discharge port 1171 forms a passage for discharging fluid compressed in the motor operated compressor 1000 to the outside. The discharge port 1171 may be protruded from an outer circumferential surface of the rear housing 1170. The discharge port 1171 may be connected to a discharge pipe (not shown) for supplying the compressed fluid to a next device of the cooling cycle. The discharge port 1171 has a shape corresponding to the discharge pipe to be coupled to the discharge pipe.

A plurality of fastening holes 1172 may be formed. The plurality of fastening holes 1172 are arranged to be spaced apart from each other along a circumference of the rear housing 1170. The rear housing 1170 may be bolt-fastened to the second scroll 1162 through the fastening holes 1172.

A side surface of the rear housing 1170 includes two portions forming a step. A portion formed with the fastening hole 1172 may form a step with another portion of the rear housing 1170. The step is repeatedly formed along an outer circumferential surface of the rear housing 1170. The portion formed with the fastening hole 1172 is disposed closer to the second scroll 1162 than the other portion. Accordingly, a bolt inserted into the fastening hole 1172 may have a relatively short length.

The fixing portion 1173 is a structure for fixing the motor operated compressor 1000. The fixing portion 1173 has the same or similar structure as the fixing portion 1113 formed on the main housing 1110. The fixing portion 1173 of the rear housing 1170 may be protruded from an outer circumferential surface of the rear housing 1170. The fixing portion 1173 may be extended along a lateral surface of the rear housing 1170. The fixing portion 1173 may have a fixing hole 1173*a* capable of coupling to any fastening member. The fixing hole 1173*a* may be open toward a direction intersecting an axial direction of the rotary shaft 1130 which will be described later.

The appearance of the inverter module 1200 is formed by an inverter housing 1210 and an inverter cover 1220.

The inverter housing 1210 is coupled to an opposite end of the rear housing 1170 between both ends of the main housing 1110, that is, a front end forming an open end of the main housing 1110, to cover a front end opening of the main housing 1110. The inverter housing 1210 may have an outer circumferential surface larger than that of the main housing 1110. Accordingly, the inverter housing 1210 may have a shape protruded from the main housing 1110. In FIG. 1, it is illustrated that the inverter housing 1210 has a shape protruded upward from the main housing 1110.

An inverter housing side fastening portion 1214 and a connector portion 1240 are formed in the inverter housing 1210. The inverter housing side fastening portion 1214 has a structure for coupling the inverter module 1200 to the compressor module 1100. The inverter housing side fastening portion 1214 may be protruded from an outer circumferential surface of the inverter housing 1210. A plurality of inverter housing side fastening portions 1214 may be formed along an outer circumferential surface of the inverter housing 1210. The plurality of inverter housing side fastening portions 1214 may be arranged to be spaced apart from each other. A fastening hole 1214*a* (see FIG. 2) for fastening a bolt is formed on the inverter housing side fastening portion 1214. The inverter housing side fastening portion 1214 may be bolt-fastened to the main housing 1110 of the compressor module 1100 through the fastening hole 1214*a*.

The main housing side fastening portion 1112 may be bolt-fastened to an outer surface 1211 of the inverter housing 1210.

The connector portion 1240 is installed to provide power to the inverter component 1230 (see FIG. 2) installed inside the inverter module 1200 and/or the drive motor 1120 installed inside the compressor module 1100. Here, the inverter component 1230 has a concept including an electrical component such as a printed circuit board and an inverter element. The connector portion 1240 may be physically and electrically connected to a mating connector (not shown). Power supplied through the mating connector is provided to the inverter component 1230 and/or the drive motor 1120 through the connector portion 1240.

The inverter cover 1220 may have substantially the same outer circumferential surface as that of the inverter housing 1210. The inverter cover 1220 and the inverter housing 1210 are coupled to each other along the circumference to accommodate the inverter component 1230 therein.

Figure 2:
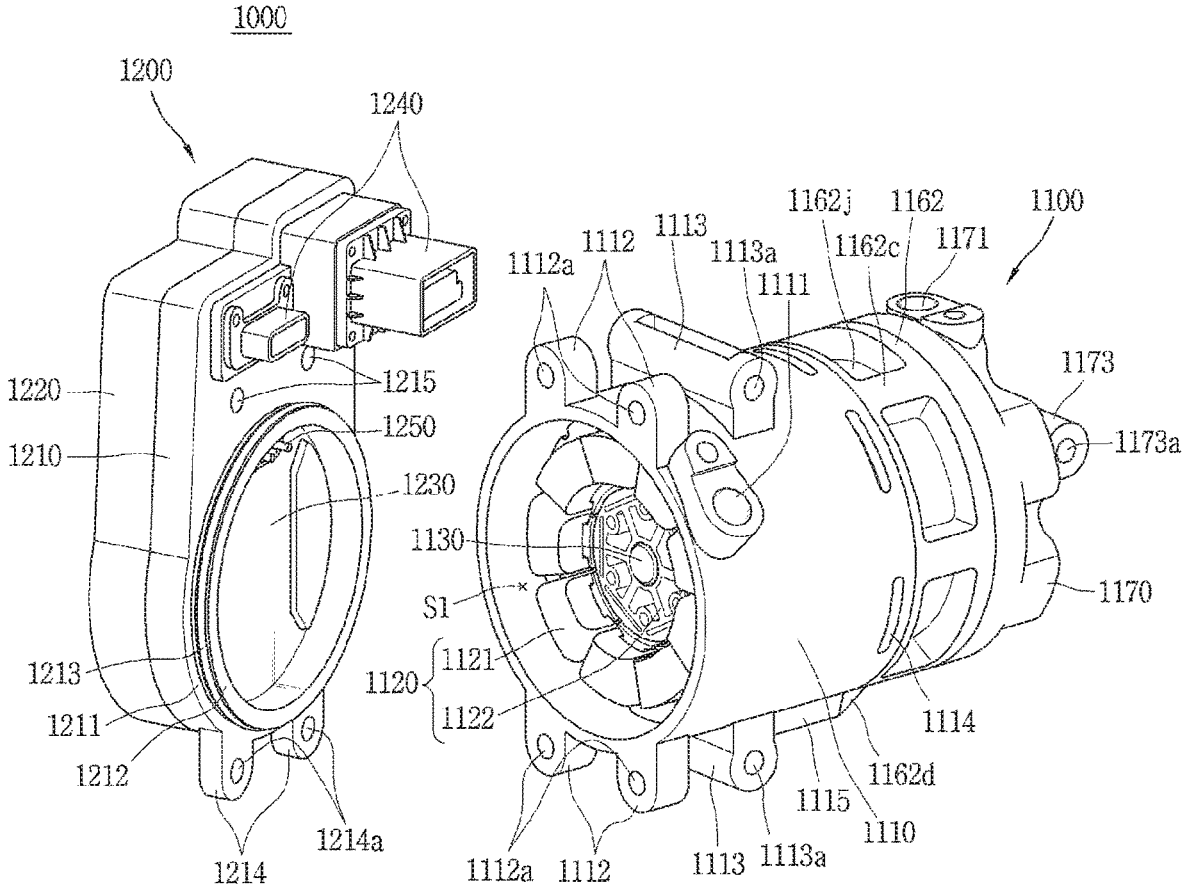
FIG. 2 is an exploded perspective view showing a compressor module and an inverter module separated from each other in the motor operated compressor illustrated in FIG. 1.

FIG. 2 is an exploded perspective view showing the compressor module 1100 and the inverter module 1200 separated from each other in the motor operated compressor 1000 illustrated in FIG. 1.

When the compressor module 1100 and the inverter module 1200 are separated from each other, a motor chamber (S1) is visually exposed.

The motor chamber (S1) is formed by the coupling of the main housing 1110 and the inverter housing 1210. The motor chamber (S1) denotes a space in which the drive motor 1120 is installed. A sealing member 1213 such as an O-ring may be installed along the coupling position of the main housing 1110 and the inverter housing 1210 to seal the motor chamber (S1).

The drive motor 1120 is installed in the motor chamber (S1). The drive motor 1120 includes a stator 1121 and a rotor 1122.

The stator 1121 is installed along an inner circumferential surface of the main housing 1110, and fixed to the inner circumferential surface of the main housing 1110. The stator 1121 is inserted and fixed to the main housing 1110 by heat shrinking (or hot pressing). Therefore, it is advantageous to assure the ease of assembly work of the stator 1121 that an insertion depth of the stator 1121 inserted into the main housing 1110 is set to be small (or shallow). Furthermore, it is advantageous to maintain the concentricity of the stator 1121 in the process of heat shrinking that an insertion depth of the stator 1121 is set to be small.

The rotor 1122 is installed in an area enclosed by the stator 1121. The rotor 1122 is rotated by electromagnetic interaction with the stator 1121.

The rotary shaft 1130 is coupled to the center of the rotor 1122. The rotary shaft 1130 transmits a rotational force generated by the drive motor 1120 while rotating together with the rotor 1122 to a compression unit 1160 (see FIG. 3) which will be described later. The rotary shaft 1130 is inserted and fixed to the rotor 1122 by heat shrinking (or hot pressing).

The inverter housing 1210 is provided with an electrical connection portion 1250 exposed toward the motor chamber (S1). The electrical connection portion 1250 is electrically connected to a printed circuit board of the inverter module 1200. The electrical connection portion 1250 may be configured to provide power to drive motor 1120.

A fastening hole 1215 configured to face the main housing side fastening portion 1112 may be formed on an outer surface 1211 of the inverter housing 1210. The main housing side fastening portion 1112 and the fastening hole 1215 may be bolt-fastened to each other. Furthermore, as described above, the inverter housing side fastening portion 1214 may have a fastening hole 1214*a* to correspond to the main housing side fastening portion 1112. The main housing side fastening portion 1112 and the inverter housing side fastening portion 1214 may be bolt-fastened to each other.

The ceiling protruding portion 1212 may be protruded from an outer surface of the inverter housing 1210. The circumference of the sealing protruding portion 1212 may have a shape corresponding to the circumference of the main housing 1110. For instance, the sealing protruding portion 1212 may be protruded in a circular shape, and an inner circumferential surface of the sealing protruding portion 1212 may be formed to be in contact with an open end inner circumferential surface of the main housing 1110. A sealing member 1213 such as an O-ring may be installed between an open end inner circumferential surface of the main housing 1110 and the sealing protruding portion 1212. The sealing member 1213 may be formed to surround the sealing protruding portion 1212.

Figure 3:
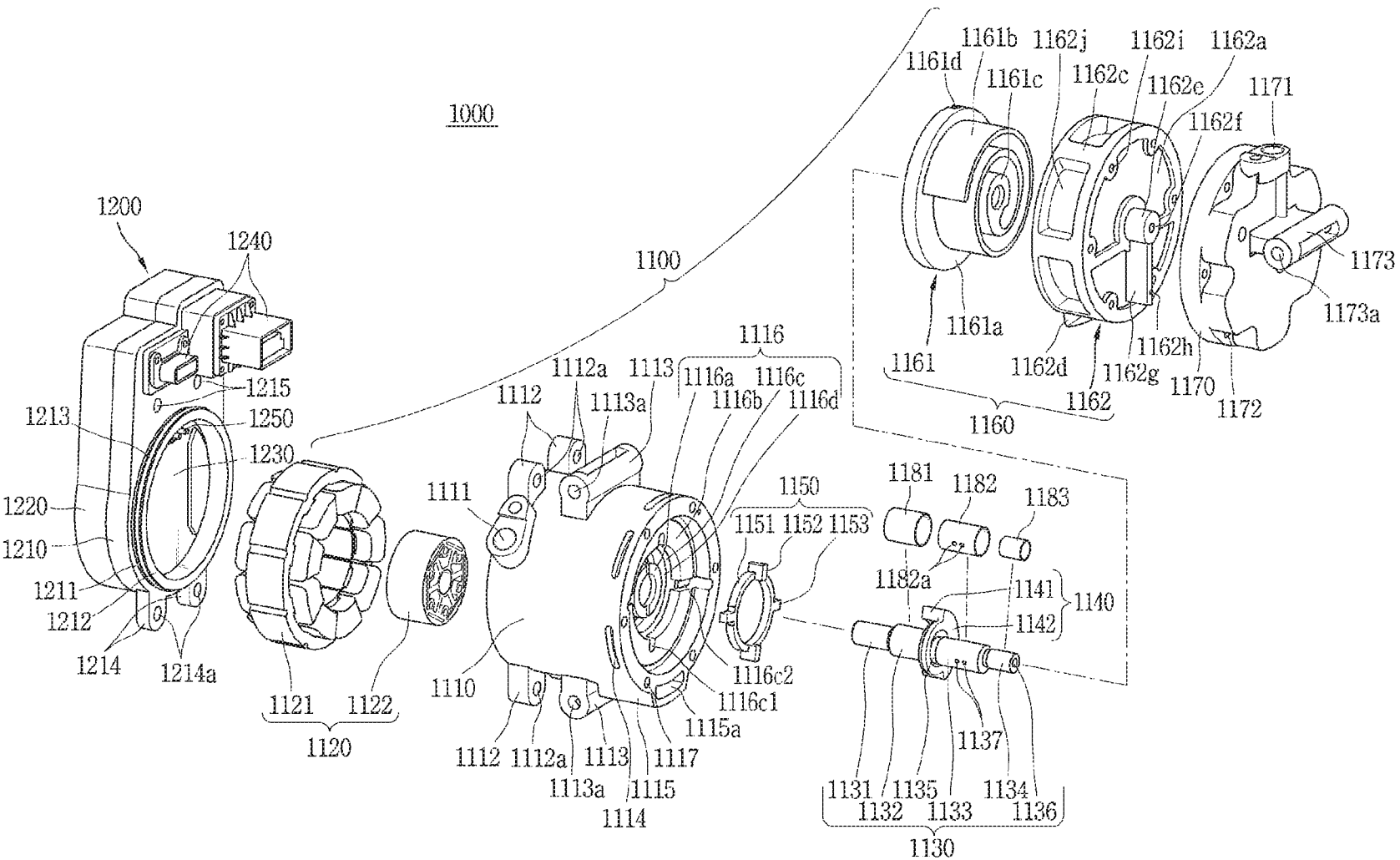
FIG. 3 is an exploded perspective view of the motor operated compressor shown in FIGS. 1 and 2.
Figure 4:
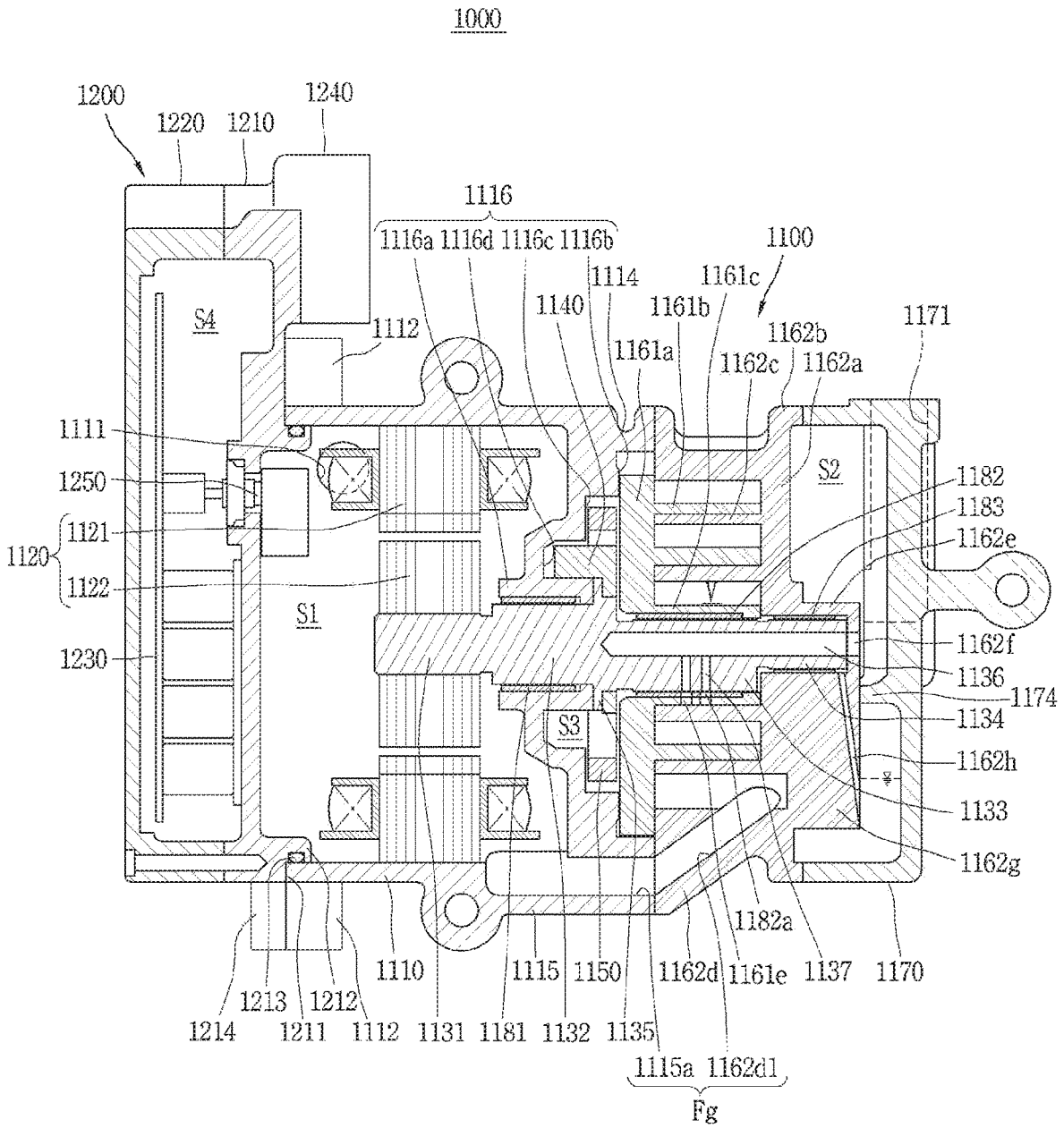
FIG. 4 is a cross-sectional view of the motor operated compressor shown in FIGS. 1 and 2.

FIG. 3 is an exploded perspective view of the motor operated compressor 1000 illustrated in FIGS. 1 and 2. FIG. 4 is a cross-sectional view of the motor operated compressor 1000 illustrated in FIGS. 1 and 2.

The motor operated compressor 1000 includes a compressor module 1100 and an inverter module 1200.

The compressor module 1100 includes a main housing 1110, a drive motor (a driving unit or an electric motor unit 1120), a compression unit 1160, and a rear housing 1170.

First, the main housing 1110 will be described.

A front end of the main housing 1110 is an open end. When the open end is a first end, a frame portion 1116 is formed at a second end corresponding to a rear end. The frame portion 1116 may be integrally formed with the main housing 1110 or may be provided with a separate member. When the frame portion is integrally formed with the main housing 1110, the process of assembling the frame portion 1116 to the main housing 1110 may be excluded, and thus the assemblability of the motor 1120 may also be improved.

The frame portion 1116 forms a boundary for partitioning an inner space of the main housing 1110. As the frame portion 1116 is formed at a second end of the main housing 1110, the second end of the main housing 1110 forms a partially blocked structure.

A front side of the frame portion 1116 is protruded in a direction toward the drive motor 1120 (toward the first end). On the contrary, a rear side of the frame portion 1116 is recessed so as to be stepped at least twice in a direction toward the drive motor 1120.

A first shaft receiving portion 1116*a* is formed at the center of the frame portion 1116. The first shaft receiving portion 1116*a* is formed in a hollow cylindrical shape so as to rotatably support the rotary shaft 1130 passing through the frame portion 1116. A first bearing 1181 formed as a bush bearing may be inserted into the first shaft receiving portion 1116*a*.

The first shaft receiving portion 1116*a* may be protruded in a direction toward the drive motor 1120. One end of the first shaft receiving portion 1116*a* facing the drive motor 1120 may be referred to as a front end. Furthermore, the first shaft receiving portion 1116*a* may be protruded in a direction toward the first scroll 1161. The other end of the first shaft receiving portion 1116*a* facing the first scroll 1161 may be referred to as a rear end. The rear end of the first shaft receiving portion 1116*a* is formed at a position surrounded by a balance weight receiving groove 1116*d* which will be described later.

A scroll mounting groove 1116*b*, a rotation prevention mechanism mounting groove 1116*c*, and a balance weight receiving groove 1116*d* are respectively formed on a rear side of the frame portion 1116. The scroll mounting groove 1116*b*, the rotation prevention mechanism mounting groove 1116*c*, the balance weight receiving groove 1116*d*, and the rear end of the first shaft receiving portion 1116*a* are continuously stepped to form a back pressure chamber (S3).

The scroll mounting groove 1116*b* is formed to axially support the first scroll 1161. The first scroll 1161 has an orbiting disk plate portion 1161*a*, and the scroll mounting groove 1116*b* forms a ring-shaped support surface corresponding to the orbiting disk plate portion 1161*a*. The ring-shaped support surface may be partitioned into a plurality of regions by key grooves 1116*c*1, 1116*c*2.

The rotation prevention mechanism mounting groove 1116*c* is formed in a region enclosed by the scroll mounting groove 1116*b*. The oldham ring 1150 has a ring-shaped ring portion 1151, and the rotation prevention mechanism mounting groove 1116*c* forms a ring-shaped support surface corresponding to the ring portion 1151 of the oldham ring 1150. The rotation prevention mechanism mounting groove 1116*c* is formed at a position more recessed toward the drive motor 1120 than the scroll mounting groove 1116*b*.

A plurality of key grooves 1116*c*1, 1116*c*2 for mounting the key portions 1152, 1153 of the oldham ring 1150 are formed on the rotation prevention mechanism mounting groove 1116*c*. The key grooves 1116*c*1, 1116*c*2 are formed in a radial direction of the rotation prevention mechanism mounting groove 1116*c*. The key grooves 1116*c*1, 1116*c*2 are formed one by one at intervals of 90° along the rotation prevention mechanism mounting groove 1116*c*.

The balance weight receiving groove 1116*d* is formed in a region surrounded by the rotation prevention mechanism mounting groove 1116*c*. The balance weight receiving groove 1116*d* is ring-shaped to rotatably receive the balance weight 1140. The balance weight receiving groove 1116*d* may be formed in a ring shape.

The first shaft receiving portion 1116*a* is formed in a region surrounded by the balance weight receiving groove 1116*d*. The first shaft receiving portion 1116*a* may be protruded from the center of the balance weight receiving groove 1116*d* to a rear side of the main housing 1110.

A first protruding portion 1115 is formed on an outer circumferential surface of the main housing 1110. A first passage 1115*a* communicating with the motor chamber (S1)

is formed inside the first protruding portion 1115. The first passage 1115*a* is formed to pass through the first protruding portion 1115. The first passage 1115*a* forms a suction passage (Fg) for communicating the compression chamber and the motor chamber (S1) to each other together with a second passage which will be described later.

A fastening hole 1117 is formed around a second end of the main housing 1110. A plurality of fastening holes 1117 may be formed. The plurality of fastening holes 1117 may be arranged to be spaced apart from each other around the second end of the main housing 1110. A fastening holes 1162*i* is also formed in the second scroll 1162 which will be described later. The fastening holes 1117 of the main housing 1110 and the fastening holes 1162*i* of the second scroll 1162 are formed at positions corresponding to each other. Accordingly, the main housing 1110 and the second scroll 1162 may be bolt-fastened to each other.

The drive motor 1120 is replaced with the foregoing description of FIG. 2.

Next, the rotary shaft 1130 will be described.

The rotary shaft 1130 includes a drive motor coupling portion 1131, a main bearing portion 1132, an eccentric portion 1133, a sub bearing portion 1134, a bearing protrusion portion 1135 and a hollow portion 1136. The drive motor coupling portion 1131, the main bearing portion 1132, the eccentric portion 1133 and the sub bearing portion 1134 are continuously formed along an axial direction of the rotary shaft 1130. The drive motor coupling portion 1131, the main bearing portion 1132, the eccentric portion 1133 and the sub bearing portion 1134 may have a cylindrical shape, and may have the same or different outer diameters.

The drive motor coupling portion 1131 is coupled to the rotor 1122. The drive motor coupling portion 1131 may be extended in an axial direction to pass through the center of the rotor 1122.

The main bearing portion 1132 is extended in an axial direction from the drive motor coupling portion 1131. The main bearing portion 1132 may have an outer diameter larger than that of the drive motor coupling portion 1131. The center of the main bearing portion 1132 coincides with the center of the drive motor coupling portion 1131 in an axial direction. The main bearing portion 1132 is inserted into the first shaft receiving portion 1116*a* of the frame portion 1116 to pass through the first shaft receiving portion 1116*a*. The first shaft receiving portion 1116*a* is formed to surround the main bearing portion 1132. The circumference of the main bearing portion 1132 is rotatably supported by the first shaft receiving portion 1116*a*.

The eccentric portion 1133 is extended in an axial direction from the main bearing portion 1132. The eccentric portion 1133 may have an outer diameter smaller than that of the main bearing portion 1132. The center of the eccentric portion 1133 does not coincide with the center of the drive motor coupling portion 1131 and/or the center of the main bearing portion 1132 in an axial direction. Therefore, the center of the eccentric portion 1133 is formed at a position eccentric from the center of the drive motor coupling portion 1131 or the center of the main bearing portion 1132. The eccentric portion 1133 is inserted into the rotary shaft coupling portion 1161*c* of the first scroll 1161 to pass through the rotary shaft coupling portion 1161*c*.

The sub bearing portion 1134 is extended in an axial direction from the eccentric portion 1133. The sub bearing portion 1134 may have an outer diameter smaller than that of the eccentric portion 1133. The center of the sub bearing portion 1134 coincides with the center of the drive motor coupling portion 1131 and/or the center of the main bearing portion 1132 in an axial direction. The sub bearing portion 1134 is inserted into a second shaft receiving portion 1162*e* of the second scroll 1162. The second shaft receiving portion 11162 is formed to surround the sub bearing portion 1134. The circumference of the sub bearing portion 1134 is rotatably supported by the second shaft receiving portion 1116*e*.

A bearing protrusion portion 1135 may be formed at a boundary between the main bearing portion 1132 and the eccentric portion 1133. The bearing protrusion portion 1135 is protruded in a radial direction along an outer circumferential surface of the rotary shaft 1130. The bearing protrusion portion 1135 has a ring-shaped bearing surface, and the bearing surface is disposed to face a rear end of the first shaft receiving portion 1116*a*. The bearing surface forms a thrust surface together with the rear end of the first shaft receiving portion 1116*a*.

Since fluid compressed in the compression unit 1160 is discharged to a rear side of the motor operated compressor 1000, the rear side of the motor operated compressor 1000 is higher in pressure than the front side. Accordingly, the rotary shaft 1130 receives pressure in a direction toward the front side of the motor operated compressor 1000. However, the bearing protrusion portion 1135 and the first shaft receiving portion 1116*a* may form a thrust surface, thereby preventing the axial movement of the rotary shaft 1130 by the bearing protrusion portion 1135.

The center of the drive motor coupling portion 1131, the center of the main bearing portion 1132, and the center of the sub bearing portion 1134 coincide with each other in an axial direction. Therefore, the center of these may be referred to as the center of the rotary shaft 1130. Furthermore, it may also be possible to use the name shaft as a concept including the drive motor coupling portion 1131, the main bearing portion 1132, and the sub bearing portion 1134. It may be understood that the drive motor coupling portion 1131, the main bearing portion 1132, and the sub bearing portion 1134 refer to different portions of the shaft portion.

The hollow portion 1136 is formed in the shaft portion and/or the eccentric portion 1133 along an axial direction. The hollow portion 1136 is formed at the center of the shaft portion, and the hollow portion 1136 is formed at a position eccentric from the center of the eccentric portion 1133. The hollow portion 1136 corresponds to the discharge passage of compressed refrigerant.

The center of the eccentric portion 1133 is located at a position eccentric from the center of the rotary shaft 1130, when the center of the shaft portion is the center of the rotational shaft 1130. Accordingly, it may be understood that the first scroll 1161 is eccentrically coupled to the rotary shaft 1130, and the eccentric portion 1133 transmits a rotational force of the drive motor 1120 to the first scroll 1161. The first scroll 1161 that has received the rotational force through the eccentric portion 1133 performs an orbiting movement by the arm 1150.

Next, the balance weight 1140 will be described.

The balance weight 1140 is coupled to the rotary shaft 1130. The balance weight 1140 is provided to cancel an eccentric load (or eccentric amount) of the rotary shaft 1130. The balance weight 1140 includes a ring portion 1141 and an eccentric mass portion 1142.

The ring portion 1141 is formed in a ring shape that surrounds the rotary shaft 1130 so as to be coupled to the rotary shaft 1130. An outer diameter of the ring portion 1141 is larger than that of the rotary shaft 1130.

The eccentric mass portion 1142 is extended from a rim of the ring portion 1141 along an axial direction or a direction parallel to the axial direction. The eccentric mass portion 1142 is protruded in an axial direction or a direction parallel to the axial direction from an arc having a constant central angle on a rim of 360° of the ring portion 1141. Accordingly, the eccentric mass portion 1142 partially surrounds the rotary shaft 1130 at a position spaced apart from the rotary shaft 1130.

Next, the oldham ring 1150 will be described.

The oldham ring 1150 is a rotation prevention mechanism that prevents the rotation of the first scroll 1161. However, for the rotation prevention mechanism, not only the oldham ring 1150 but also a mechanism composed of a pin and a ring may be applicable. The oldham ring 1150 is disposed between the frame portion 1116 of the main housing 1110 and the first scroll 1161. The oldham ring 1150 is mounted on the rotation prevention mechanism mounting groove 1116*c* of the frame portion 1116. The oldham ring 1150 is supported by the frame portion 1116 in an axial direction.

The oldham ring 1150 includes a ring portion 1151 and key portions 1152, 1153.

The ring portion 1151 is formed in a ring shape or a shape similar to a ring. The ring portion 1151 is formed to have a size corresponding to that of the rotation prevention mechanism mounting groove 1116*c*. The ring portion 1151 is mounted on the rotation prevention mechanism mounting groove 1116*c*.

The key portions 1152, 1153 are protruded from the ring portion 1151. The key portions 1152, 1153 are configured with a pair of first keys 1152 and a pair of second keys 1153.

A pair of first keys 1152 are formed at positions at an angle of 180 degrees with respect to each other in the ring portion 1151. Furthermore, a pair of second keys 1153 are also formed at positions at an angle of 180 degrees with respect to each other in the ring portion 1151. The first key 1152 and the second key 1153 are alternately formed along the ring portion 1151. The first key 1152 and the second key 1153 are formed at positions having an angle of 90 degrees with respect to each other.

The first key 1152 is protruded in a radial direction of the ring portion 1151 and toward the first scroll 1161. The first key 1152 is inserted into a first scroll side key groove 1161*d*. Furthermore, the first key 1152 may be inserted into the frame portion side key groove 1116*c*1.

The second key 1153 is protruded in a radial direction of the ring portion 1151. The second key 1153 may be protruded toward the frame portion 1116. The second key 1153 is inserted into the frame portion side key groove 1116*c*2.

Next, the compression unit 1160 will be described.

The compression unit 1160 is formed to compress fluid subject to compression such as refrigerant. The compression unit 1160 includes a first scroll 1161 and a second scroll 1162. The compression unit 1160 is formed by the first scroll 1161 and the second scroll 1162.

The first scroll 1161 is provided on one side of the drive motor 1120. The first scroll 1161 is mounted on the scroll receiving groove 1116*b* of the frame portion 1116. The first scroll 1161 is axially supported by the frame portion 1116.

The first scroll 1161 is coupled to the eccentric portion 1133 of the rotary shaft 1130. Accordingly, the first scroll 1161 is eccentrically coupled to the rotary shaft 1130. The first scroll 1161 that has received the rotational force through the eccentric portion 1133 performs an orbiting movement by the arm 1150. The first scroll 1161 may be referred to as an orbiting scroll in that it performs an orbiting movement.

The second scroll 1162 is fixed at a position facing the first scroll 1161. The second scroll 1162 is coupled to a second end (rear end) of the main housing 1110. The second scroll 1162 may be referred to as a fixed scroll or non-orbiting scroll in that it is fixed. The second scroll 1162 is disposed between the first scroll 1161 and the rear housing 1170.

The first scroll 1161 and the second scroll 1162 are coupled to each other to form a pair of compression chambers (V). As the first scroll (1161) performs an orbiting movement, a volume of the compression chamber (V) varies repeatedly, and thus fluid is compressed in the compression chamber (V).

The first scroll 1161 includes an orbiting disk portion 1161*a*, an orbiting wrap 1161*b*, and a rotary shaft coupling portion 1161*c*.

The orbiting disk portion 1161*a* is formed in a plate shape corresponding to an inner circumferential surface of the main housing 1110. When the inner circumferential surface of the main housing 1110 has a cross section corresponding to a circle, the orbiting disk portion 1161*a* has a circular plate shape.

When one surface facing the second scroll 1162 between both surfaces of the orbiting disk portion 1161*a* is referred to as a first surface, the orbiting wrap 1161*b* is protruded on the first surface. When the other surface facing the frame portion 1116 between both surfaces of the orbiting disk portion 1161*a* is referred to as a second surface, a first scroll side key groove 1161*d* is formed on the second surface. The first scroll side key groove 1161*d* is formed to accommodate the first key 1152 of the oldham ring 1150, and the first scroll side key groove 1161*d* is extended along a radial direction of the orbiting disk portion 1161*a*.

The orbiting wrap 1161*b* is protruded in an involute curve shape from a first surface of the orbiting disk portion 1161*a* toward the second scroll 1162. An involute curve denotes a curve corresponding to a trajectory drawn by an end portion of a thread when the thread wound around a base circle having an arbitrary radius is unwound. The orbiting wrap 1161*b* is engaged with a fixed wrap 1162*b* which will be described later to form a compression chamber (V) on an inner side surface and an outer side surface of the fixed wrap 1162*b*, respectively.

The rotary shaft coupling portion 1161*c* is formed at the center of the orbiting disk portion 1161*a*. The rotary shaft coupling portion 1161*c* is formed in a hollow cylindrical shape to accommodate the eccentric portion 1133 of the rotary shaft 1130. The rotary shaft coupling portion 1161*c* may be protruded from a first surface of the orbiting disk portion 1161*a* toward the second scroll 1162. The rotary shaft coupling portion 1161*c* is formed at a position corresponding to a base circle in an involute shape. Accordingly, a circumference of the rotary shaft coupling portion 1161*c* may form a base circle in an involute curve described earlier in the orbiting wrap 1161*b*. Therefore, the rotary shaft coupling portion 1161*c* forms an innermost portion of the orbiting wrap 1161*b*.

The eccentric portion 1133 passes through the rotary shaft coupling portion 1161*c* in an axial direction. A second bearing 1182 is inserted into the rotary shaft coupling portion 1161*c*. The second bearing 1182 is disposed between the eccentric portion 1133 and the rotary shaft coupling portion 1161*c*. The second bearing 1182 forms a bearing surface with the eccentric portion 1133 inserted into the rotary shaft coupling portion 1161*c*. The second bearing 1182 may be formed in a hollow cylindrical shape to surround the eccentric portion 1133. In a radial direction of the first scroll 1161, the rotary shaft coupling portion 1161*c* and/or the second bearing 1182 are arranged to overlap with the orbiting wrap 1161*b*. The second bearing 1182 is formed with a bush bearing side discharge hole 1182*a*.

The second scroll 1162 includes a fixed disk portion 1162*a*, a fixed wrap 1162*b*, a sidewall portion 1162*c*, a second protruding portion 1162*d*, a second shaft receiving portion 1162*e*, a second scroll side discharge hole 1162*f*, an oil guide protruding portion 1162*g*, an oil guide passage 1162*h*, a fastening hole 1162*i*, and a slot groove 1162*j*.

The fixed disk portion 1162*a* is formed in a plate shape corresponding to a second end of the main housing 1110. When a circumference of the second end has a cross section corresponding to a circle, the fixed disk portion 1162*a* has a circular plate shape.

When one surface facing the first scroll 1161 between both surfaces of the orbiting disk portion 1162*a* is referred to as a first surface, the fixed wrap 1162*b* is formed on the first surface. However, the fixed wrap 1162*b* is not visually seen in FIG. 3, but is seen in FIG. 4. When the other surface facing the rear housing 1170 between both surfaces of the fixed disk portion 1162*a* is referred to as a second surface, the second shaft receiving portion 1162*e*, the oil guide protruding portion 1162*g*, the fastening hole 1162*i*, and the like are formed on the second surface.

The fixed wrap 1162*b* may be formed in an involute shape similarly to the orbiting wrap 1161*b*. The fixed wrap 1162*b* may be formed in various other shapes. As described above, the fixed wrap 1162*b* is engaged with the orbiting wrap 1161*b* to form a compression chamber (V). The orbiting wraps 1161*b* are inserted between the fixed wraps 1162*b*, and the fixed wraps 1162*b* are inserted between the orbiting wraps 1161*b*.

The sidewall portion 1162*c* is protruded toward a second end of the main housing 1110 along a rim of the fixed disk portion 1162*a*. The sidewall portion 1162*c* is formed to surround the fixed wrap 1162*b* in a radial direction of the second scroll 1162.

The second protruding portion 1162*d* is protruded from the sidewall portion 1162*c*. The second protruding portion 1162*d* is formed to correspond to the first protruding portion 1115 of the main housing 1110 described above. A second passage 1162*d*1 is formed inside the second protruding portion 1162*d*. The second passage 1162*d*1 may be formed parallel to the axial direction or may be formed to be inclined with respect to the axial direction. The second passage 1162*d*1 forms a suction passage (Fg) together with the first passage 1115*a* formed inside the first protruding portion 1115.

When the second passage 1162*d*1 is formed in an axial direction, an outer diameter of the fixed disk portion 1162*a* may be enlarged. Accordingly, a winding length of the fixed wrap 1162*b* with respect to the same outer diameter of the main housing 1110 may be increased. When the second passage 1162*d*1 is formed in an inclined manner, the winding length of the fixed wrap 1162*b* may be reduced compared to the same capacity of the compression chamber (V), thereby downsizing the motor operated compressor 1000.

The second shaft receiving portion 1162*e* is formed at the center of the fixed disk portion 1162*a*. The second shaft receiving portion 1162*e* is formed to accommodate the sub bearing portion 1134 of the rotary shaft 1130. The second shaft receiving portion 1162*e* may be formed to be recessed in an axial direction from the fixed disk portion 1162*a* toward the rear housing 1170. When a surface accommodating the rotary shaft 1130 is referred to as an inner surface, and a surface facing the rear housing 1170 is referred to as an outer surface, the second shaft receiving portion 1162*e* is recessed from the inner surface and protruded from the outer surface.

The second shaft receiving portion 1162*e* may be formed by increasing a thickness of the fixed disk portion 1162*a* as shown in FIG. 3, but in this case, a weight of the second scroll 1162 may increase while an unnecessary portion thereof is formed to be thick, thereby increasing dead volume. The dead volume a volume that is wasted in a structurally and functionally useless manner.

The second scroll 1162 is disposed to face one end of the rotary shaft 1130. The second shaft receiving portion 11162 is formed to surround an outer circumferential surface and an end portion of the sub bearing portion 1134. The sub bearing portion 1134 of the rotary shaft 1130 is inserted into the second shaft receiving portion 1162*e*. The sub bearing portion 1134 is supported in a radial direction by the second shaft receiving portion 1162*e*.

An end portion (rear end) of the second shaft receiving portion 1162*e* is formed into a closed cylindrical shape except for the second scroll side discharge hole 1162*f* which will be described later. A third bearing 1183 is inserted into the second shaft receiving portion 1162*e*. The third bearing 1183 may be formed in a hollow cylindrical shape to surround the sub bearing portion 1134 of the rotary shaft 1130. The third bearing 1183 is disposed between the second shaft receiving portion 1162*e* and the sub bearing portion 1134. The third bearing 1183 forms a bearing surface with the sub bearing portion 1134. The third bearing 1183 may be formed of a bush bearing or a needle bearing. In a radial direction of the second scroll 1162, the second shaft receiving portion 1162*e* is disposed to overlap with the sub bearing portion 1134 and/or the third bearing 1183.

The second scroll side discharge hole 1162*f* is formed at a position facing the hollow portion 1136 of the rotary shaft 1130. For example, the second scroll side discharge hole 1162*f* may be formed in the second shaft receiving portion 1162*e*. A discharge valve formed to open and close the second scroll side discharge hole 1162*f* may be provided as the need arises. The discharge valve is formed to open above a reference pressure.

The second scroll side discharge hole 1162*f* is formed between the hollow portion 1136 and the oil separation chamber (S2).

The oil guide protruding portion 1162*g* is formed below the second shaft receiving portion 1162*e*. The oil guide protruding portion 1162*g* is protruded downward from the second shaft receiving portion 1162*e* or protruded from the fixed disk portion 1162*a* toward the rear housing 1170. An oil guide passage 1162*h* may be formed inside the oil guide protruding portion 1162*g*.

The oil guide passage 1162*h* passes through the second scroll 1162 to supply oil stored in the oil separation chamber (S2) to a bearing surface of the rotary shaft 1130. For example, the oil guide passage 1162*h* may be formed to pass through the oil guide protruding portion 1162*g* and the fixed disk portion 1162*a*. The bearing surface of the rotary shaft 1130 denotes an outer circumferential surface of the main bearing portion 1132, an outer circumferential surface of the eccentric portion 1133, and an outer circumferential surface of the sub bearing portion 1134. Part of oil flows into the back pressure chamber (S3) to form a back pressure for supporting the first scroll 1161 toward the second scroll 1162.

The fastening holes 1162*i* are formed at positions corresponding to the fastening holes 1117 of the main housing 1110 and the fastening holes 1172 of the rear housing 1170.

The fastening holes 1162*i* may be formed along a circumference of the fixed disk portion 1162*a*. The fastening holes 1162*i* may be formed to pass through the fixed disk portion 1162*a* and the sidewall portion 1162*c*. The fastening hole 1162*i* may be formed at a position where the slit groove 1162*j* is not formed or may be formed at a position passing between the two slit grooves 1162*j*.

The slit groove 1162*j* formed in the sidewall portion 1162*c* are replaced with the foregoing description.

Next, the rear housing 1170 will be described.

When the drive motor 1120 is formed on one side of the compression unit 1160, the rear housing 1170 is formed on the other side of the compression unit 1160. For instance, the rear housing 1170 is formed on an opposite side of the drive motor 1120 with respect to the compression unit 1160.

The rear housing 1170 has an open first end and a closed second end. Assuming that the side of the drive motor 1120 is a front side, the first end corresponds to a front end and the second end corresponds to a rear end. When a bolt is inserted through the fastening hole 1172 formed in the rear housing 1170, the bolt is coupled to the fastening hole 1117 of the main housing 1110 by sequentially passing through the fastening hole 1172 of the rear housing 1170 and the fastening hole 1162*i* of the second scroll 1162. Accordingly, the main housing 1110, the second scroll 1162, and the rear housing 1170 may be bolt-fastened together.

The rear end of the rear housing 1170 is spaced apart from the second scroll 1162. Accordingly, the oil separation chamber (S2) is formed between the rear housing 1170 and the second scroll 1162. The oil separation chamber (S2) corresponds to a space for accommodating fluid being compressed and then discharged from the compression unit 1160, and corresponds to a space for accommodating oil to be supplied to a bearing surface of the rotary shaft 1130. A sealing member (not shown) such as a gasket may be provided between the rear housing 1170 and the second scroll 1162 for the sealing of the oil separation chamber (S2).

The rear housing 1170 has a support protruding portion 1174 protruded toward the second scroll 1162. The support protruding portion 1174 is protruded from an inner surface of the second end. Here, the inner surface refers to a surface opposite to an outer surface from which the fixing portion 1173 is protruded. The support protruding portion 1174 may be protruded to a position in contact with the oil guide protruding portion 1162*g* of the second scroll 1162. The support protruding portion 1174 supports the second scroll 1162 toward the first scroll 1161 along an axial direction.

Next, the inverter module 1200 will be described.

The inverter housing 1210 is coupled to an opposite side of the rear housing 1170 between both ends of the main housing 1110, for example, at a front end forming an opening end of the main housing 1110. The inverter housing 1210 is coupled to the inverter cover 1220 to form an inverter chamber (S4) therebetween. The inverter housing 1210 and the inverter cover 1220 may be bolt-fastened.

The inverter component 1230 is mounted in the inverter chamber (S4). The electrical connection portion 1250 is electrically connected to the inverter component 1230. The electrical connection portion 1250 is exposed toward the motor chamber (S1).

Next, the structure of a discharge passage proposed in the present disclosure will be described.

Figure 5:
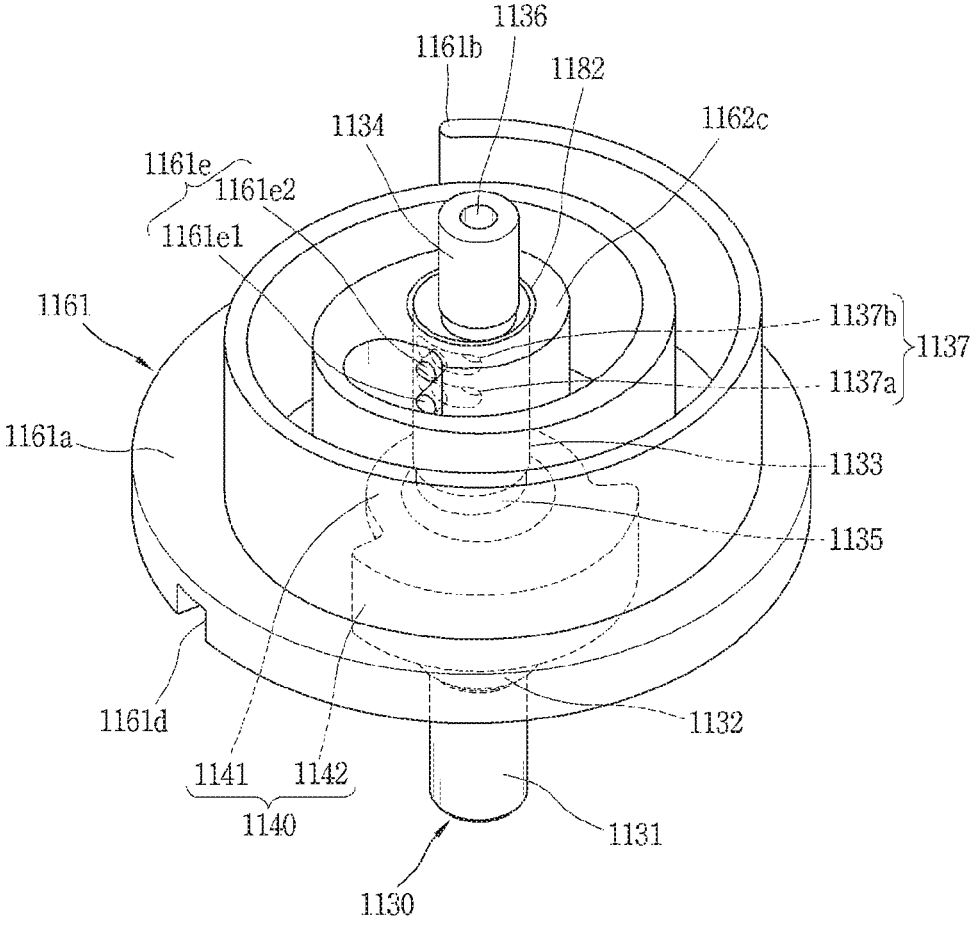
FIG. 5 is a perspective view of a rotary shaft, a first scroll and a second bearing for explaining a discharge passage.

FIG. 5 is a perspective view of a rotary shaft 1130, a first scroll 1161 and a second bearing 1182 for explaining the discharge passage.

The hollow portion 1136 is formed inside the rotary shaft 1130. The hollow portion 1136 may be formed to extend along an axial direction from the center of the rotary shaft 1130.

The hollow portion 1136 is formed to be exposed to an end portion of the sub bearing portion 1134. When the rotary shaft 1130 is viewed from a side of the sub bearing portion 1134, the hollow portion 1136 is visually seen. Accordingly, fluid compressed by the compression unit 1160 may be discharged to an end portion of the sub bearing portion 1134 along the hollow portion 1136.

On the contrary, an end portion of the main bearing portion 1132 is closed. The end portion of the main bearing portion 1132 has a closed structure to discharge compressed fluid from the compression unit 1160 only toward the side of the sub bearing portion 1134.

On the other hand, the eccentric portion 1133 is eccentrically formed from the center of the rotary shaft 1130. Since the center of the eccentric portion 1133 is eccentrically located from the center of the rotary shaft 1130, an outer circumferential surface of the eccentric portion 1133 is also eccentrically formed from the center of the rotary shaft 1130.

The rotary shaft side discharge hole 1137 is formed in the eccentric portion 1133. The rotary shaft side discharge hole 1137 is formed along a radial direction of the eccentric portion 1133 to communicate from an outer circumferential surface of the eccentric portion 1133 to the hollow portion 1136 of the rotary shaft 1130. Accordingly, fluid drawn into the rotary shaft side discharge hole 1137 is continuously discharged through the rotary shaft side discharge hole 1137 and the hollow portion 1136.

The rotary shaft side discharge hole 1137 may be formed to have a long hole shape. Here, the long hole denotes a shape in which a length of a curve extended along an outer circumferential surface of the eccentric portion 1133 is larger than that of a curve or a straight line extended along an axial direction of the rotary shaft 1130. For instance, an axial direction length of the long hole is relatively small, and a circumferential direction length thereof is relatively large.

The axial direction length of the rotary shaft side discharge hole 1137 may be constant at any position. On the contrary, a circumferential direction width of the rotary shaft side discharge hole 1137 gradually increases from an inner circumferential surface of the hollow portion 1136 to an outer circumferential surface of the eccentric portion 1133.

A single or a plurality of rotary shaft side discharge holes 1137 may be formed. When a plurality of rotary shaft side discharge holes 1137*a*, 1137*b* are formed, the plurality of rotary shaft side discharge holes 1137*a*, 1137*b* may be formed at positions spaced from each other along an axial direction of the rotary shaft 1130 or may be formed at positions spaced apart from each other in a direction intersecting an axial direction along a circumferential of the eccentric portion 1133.

The rotary shaft coupling portion 1161*c* of the first scroll 1161 is formed to surround an outer circumferential surface of the eccentric portion 1133. The rotary shaft coupling portion 1161*c* is provided with a first scroll side discharge hole 1161*e* to discharge compressed fluid to the rotary shaft side discharge holes 1137. The first scroll side discharge hole 1161*e* is formed along a radial direction of the rotary shaft coupling portion 1161*c* to pass through the rotary shaft coupling portion 1161*c*.

The first scroll side discharge holes 1161*e* are formed at positions periodically facing the rotary shaft side discharge holes 1137. The rotary shaft 1130 and the first scroll 1161 continuously rotate relative to each other while the motor operated compressor 1000 operates. Accordingly, the relative positions of the first scroll side discharge hole 1161*e* and the rotary shaft side discharge hole 1137 are continuously changed. However, when the first scroll side discharge hole 1161*e* and the rotary shaft side discharge hole 1137 are formed at positions coinciding with each other in an axial direction, they face each other periodically during the relative rotation process.

The time when the first scroll side discharge hole 1161*e* and the rotary shaft side discharge hole 1137 are disposed to face each other may be regarded as the time when the discharge passage is connected thereto. On the contrary, the time when the first scroll side discharge hole 1161*e* and the rotary shaft side discharge hole 1137 do not face each other may be regarded as the time when the discharge passage is blocked therefrom.

The first scroll side discharge hole 1161*e* may be formed to have a circular cross section. A single or a plurality of rotary shaft side discharge holes 1161*e* may be formed. In the case where a plurality of rotary shaft side discharge holes 1137 are formed, a plurality of first scroll side discharge holes 1161*e* may also be formed. The plurality of first scroll side discharge holes 1161*e*1, 1161*e*2 may be formed at positions spaced apart from each other along an axial direction of the rotary shaft 1130 or may be formed at positions spaced apart from each other in a direction intersecting an axial direction along an inner circumferential surface of the rotary shaft coupling portion 1161*c*.

On the other hand, the second bearing 1182 is inserted between the rotary shaft coupling portion 1161*c* and the eccentric portion 1133, and the discharge hole 1182*a* (see FIGS. 3 and 4) is formed in the second bearing 1182. It will be described with reference to FIG. 6.

Figure 6:
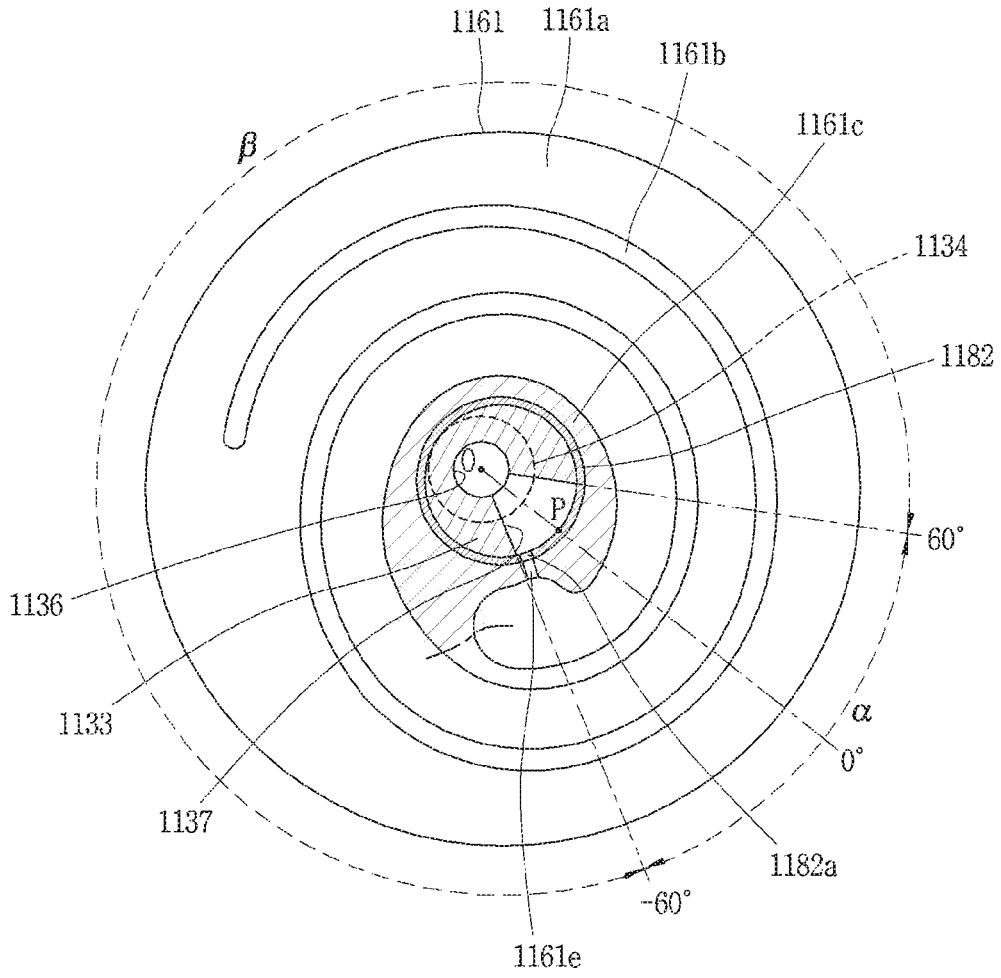
FIG. 6 is a cross-sectional view corresponding to position "A-A" in FIG. 4.

FIG. 6 is a cross-sectional view corresponding to position "A-A" in FIG. 4.

The foregoing second bearing 1182 is formed with a bush bearing 1182. The bush bearing 1182 is formed to surround the eccentric portion 1133. For instance, the bush bearing 1182 has a hollow cylindrical shape, and both ends of the bush bearing 1182 are open.

The bush bearing 1182 is disposed between the eccentric portion 1133 and the rotary shaft coupling portion 1161*c*. The bush bearing 1182 is press-fitted into the rotary shaft coupling portion 1161*c* of the first scroll 1161, and fixed to an inner circumferential surface of the rotary shaft coupling portion 1161*c*.

The bush bearing 1182 is formed with a bush bearing side discharge hole 1182*a*. The bush bearing side discharge hole 1182*a* is formed at a position facing the first scroll side discharge hole 1161*e*.

The rotary shaft 1130 and the first scroll 1161 rotate relative to each other. On the contrary, the bush bearing 1182 is fixed to an inner circumferential surface of the rotary shaft coupling portion 1161*c*. A relative position between the rotary shaft coupling portion 1161*c* and the bush bearing 1182 is fixed to maintain a state in which the first scroll side discharge hole 1161*e* and the bush bearing side discharge hole 1182*a* face each other.

The bush bearing and the rotary shaft 1130 rotate relative to each other. Therefore, the bush bearing side discharge holes 1182*a* periodically face the rotary shaft side discharge holes 1137.

A cross section of the rotary shaft side discharge hole 1137 has an annulus sector shape. An annulus sector refers to a shape obtained by subtracting a small one from a larger one of two sectors having the same origin and the same central angle. For example, the larger one of the two sectors denotes a sector having the center of the rotary shaft 1130 as the origin and an outer circumference of the eccentric portion 1133 as the radius. Furthermore, the larger one of the two sectors denotes a sector having the center of the rotary shaft 1130 as the origin and an outer circumference of the eccentric portion 1136 as the radius.

When a small one is subtracted from a larger one of the two sectors, it is formed in a shape that part of the ring is disconnected, not in a complete ring shape. Such a shape may be referred to as an annulus sector shape.

The bush bearing side discharge hole 1182*a* may have a circular cross section to correspond to the first scroll side discharge hole 1161*e*. The bush bearing side discharge hole 1182*a* and the first scroll side discharge hole 1161*e* are coupled to each other to form a continuous passage. In this case, the bush bearing side discharge hole 1182*a* formed on an outer circumferential surface of the bush bearing 1182 and the first scroll side discharge hole 1161*e* formed on an inner circumferential surface of the rotary shaft coupling portion 1161*c* have the same shape.

On the other hand, when the eccentric portion 1133 is divided into two portions with respect to a radial direction of the eccentric portion 1133, a first portion corresponds to a relatively thick portion, and a second portion corresponds to a relatively thin portion. At this time, the second portion is formed on both sides of the first portion. Furthermore, the rotary shaft side discharge hole 1137 is formed in the first portion.

Since the eccentric portion 1133 is formed eccentrically from the center of the rotary shaft 1130, a thickness of the eccentric portion 1133 is not constant with respect to the center of the rotary shaft 1130. Therefore, assuming that there is a reference point (P) in a portion having the largest thickness in the eccentric portion 1133, a position of forming the rotary shaft side discharge hole 1137 may be described based on the reference point (P).

Since an outer circumferential surface of the eccentric portion 1133 corresponds to a circle, the reference point (P) may be defined as 0° which is a reference of the circular coordinate. Under this assumption, the rotary shaft side discharge holes 1137 is formed within a range of −60° to +60° of the reference. This angle is determined on the basis of a pressure of fluid compressed in the compression unit 1160. It will be described later with reference to FIG. 7.

The first scroll side discharge hole 1161*e* is formed at a portion having the smallest radial direction thickness in the rotary shaft coupling portion 1161*c*. Referring to FIG. 6, it may be seen that the rotary shaft coupling portion 1161*c* has the smallest thickness at a position formed with the first scroll side discharge hole 1161*e*. Since the fluid is compressed to the maximum at this position, a position capable of discharging fluid compressed to the maximum is selected as a position of the first scroll side discharge hole 1161*e*.

When the rotary shaft coupling portion 1161*c* is divided into two portions with respect to a radial direction of the rotary shaft coupling portion 1161*c*, a first portion corresponds to a relatively thin portion and a second portion corresponds to a relatively thick portion. At this time, the second portion is formed on both sides of the first portion. Furthermore, the first scroll side discharge hole 1161*e* is formed in the first portion.

A size of the first scroll side discharge hole 1161*e* is smaller than that of the rotary shaft side discharge hole 1137. For example, even when an axial direction length of the first scroll side discharge hole 1161*e* and an axial direction length of the rotary shaft side discharge hole 1137 are the same, a circumferential direction width of the first scroll side discharge hole 1161*e* is smaller than that of the rotary shaft side discharge hole 1137. For another example, when the shape of the rotary shaft side discharge hole 1137 corresponds to a long hole, the shape of the first scroll side discharge hole 1161*e* may correspond to a circle. Accordingly, a flow rate of fluid discharged through the discharge passage may be determined by the first scroll side discharge hole 1161*e*.

An angle of forming the rotary shaft side discharge holes 1137 which will be described later will be described below with reference to FIG. 7.

Figure 7:
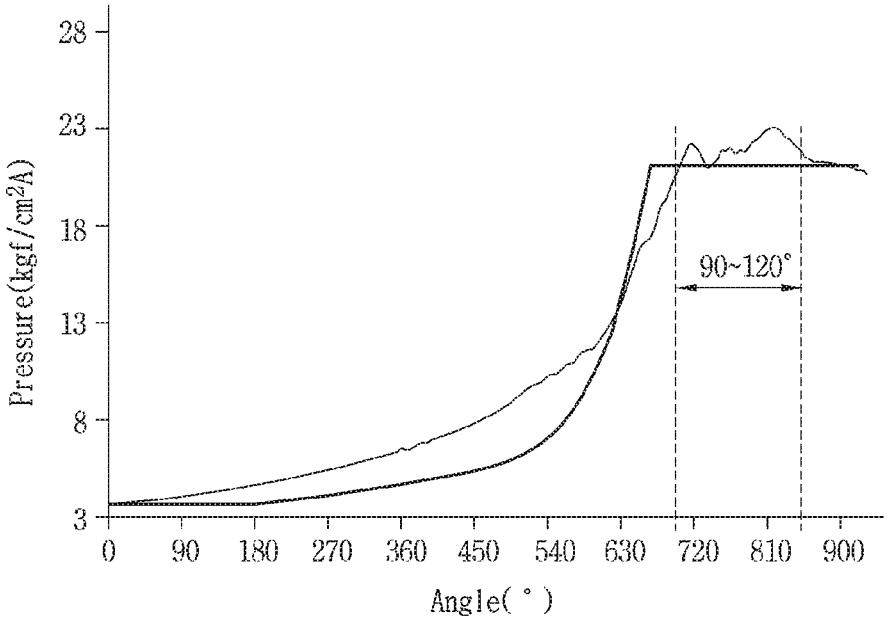
FIG. 7 is a graph showing a relationship between a rotational angle of an eccentric portion and a pressure of fluid.

FIG. 7 is a graph showing a relationship between a rotational angle of the eccentric portion 1133 and a pressure of fluid.

The horizontal axis of the graph indicates a rotation angle of the eccentric portion 1133, and the vertical axis of the graph indicates a fluid pressure at the corresponding rotation angle.

When the rotation angle of the eccentric portion 1133 is 0° when the compression of fluid is started, the rotation angle of the eccentric portion 1133 gradually increases while the compression of fluid is carried out. Since the compression of fluid is carried out in the compression unit 1160 while the rotation angle of the eccentric portion 1133 increases, the pressure of fluid also increases.

When the pressure of fluid increases to the maximum, the compressed fluid must be discharged, and the rotation angle of the eccentric portion 1133 is about 710° to 830° at this time. Therefore, the rotary shaft side discharge hole 1137 is formed to have a size corresponding to an angle of about 120° on an outer circumferential surface of the eccentric portion 1133. The size corresponding to an angle of about 120° on an outer circumferential surface of the eccentric portion 1133 denotes a range of −60° to +60° on both sides of 0° which is a reference of the circular coordinate.

Hereinafter, the operation of the motor operated compressor 1000 will be described.

Figure 8A:
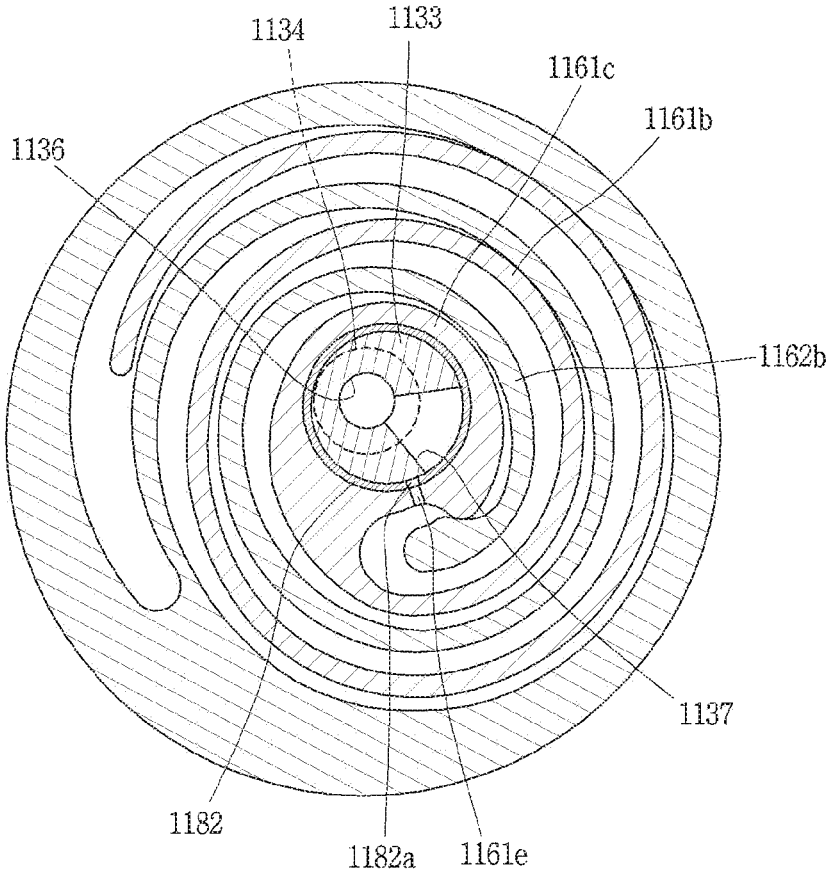
FIGS. 8A and 8B are operation state diagrams of a motor operated compressor.
Figure 8B:
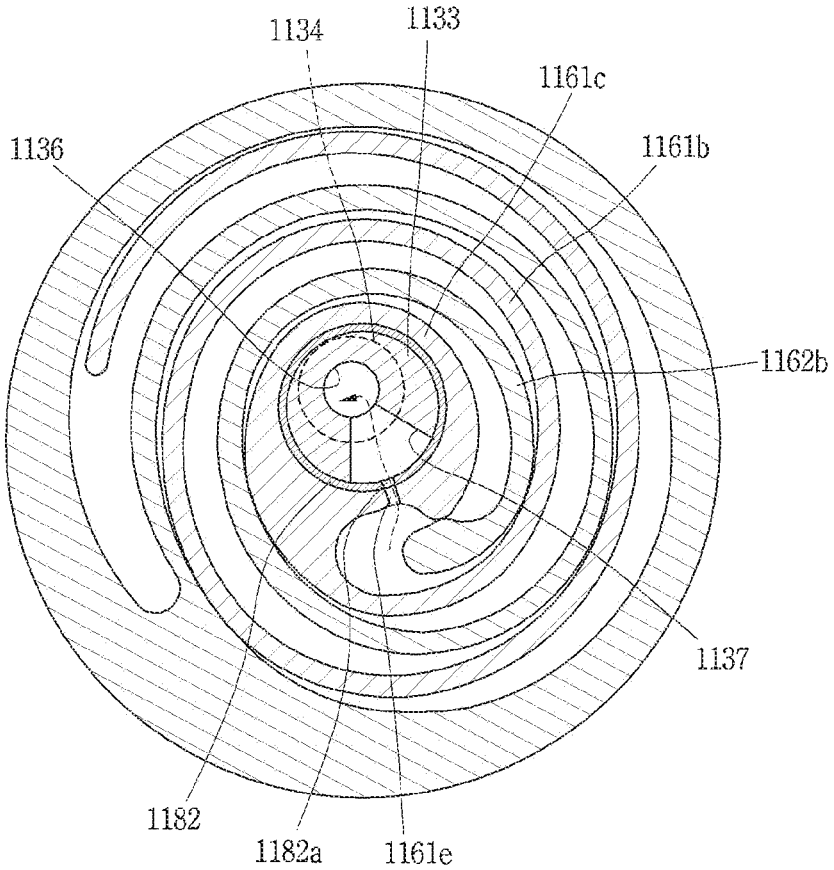

FIGS. 8A and 8B are operation state diagrams of the motor operated compressor 1000.

When the rotary shaft 1130 rotates in place, the eccentric portion 1133 rotates eccentrically along the rotary shaft 1130. Furthermore, the first scroll 1161 performs an orbiting movement by the rotation prevention mechanism. A relative position between the rotary shaft side discharge hole 1137 and the first scroll side discharge hole 1161*e* is continuously changed in accordance with a relative rotation between the rotary shaft 1130 and the first scroll 1161.

After the first scroll-side discharge hole 1161*e* and the bush-bearing-side discharge hole 1182*a* pass one end of the rotary shaft side discharge hole 1137, the suction of refrigerant is carried out.

While the first scroll side discharge hole 1161*e* and the bush bearing side discharge hole 1182*a* turn around an outer circumferential surface of the eccentric portion 1133 to come close to the other end of the rotary shaft side discharge hole 1137, the compression of fluid is carried out. During this process, the discharge passage is theoretically cut off, fluid compressed by the compression unit 1160 is not discharged.

When the first scroll side discharge hole 1161*e* and the bush bearing side discharge hole 1182*a* are located at positions facing the rotary shaft side discharge holes 1137, the discharge passage that has been cut off is connected. The discharge passage is formed by the first scroll side discharge hole 1161*e*, the bush bearing side discharge hole 1182*a*, the rotary shaft side discharge hole 1137, the hollow portion 1136, and the second scroll side discharge hole 1162*f*. The compressed fluid is sequentially passed through the first scroll side discharge hole 1161*e*, the bush bearing side discharge hole 1182*a*, the rotary shaft side discharge hole 1137, the hollow portion 1136, and the second scroll side discharge hole 1162*f* and discharged to the oil separation chamber (S2).

When the compressed fluid is composed of refrigerant and oil, the oil is separated from the refrigerant in the oil separation chamber (S2), and the refrigerant is discharged to the discharge port 1171 formed in the rear housing 1170.

According to the above structure, the discharge passage is formed in the hollow portion 1136 of the rotary shaft 1130. Therefore, the passage configuration is simple, and there are very few factors causing flow resistance and compression efficiency degradation. In addition, since the closing and opening of the discharge passage is carried out periodically, naturally, in accordance with the rotation of the rotary shaft 1130, periodic discharge may be carried out without leakage of compressed fluid with no discharge valve. In particular, only a single discharge hole formed in the rotary shaft 1130 may discharge high-pressure refrigerant, and thus the present disclosure is advantageous for simplification, downsizing, and optimum design of compressor structure.

Hereinafter, an application example of discharge passage structure provided by the present disclosure will be described.

Figure 9:
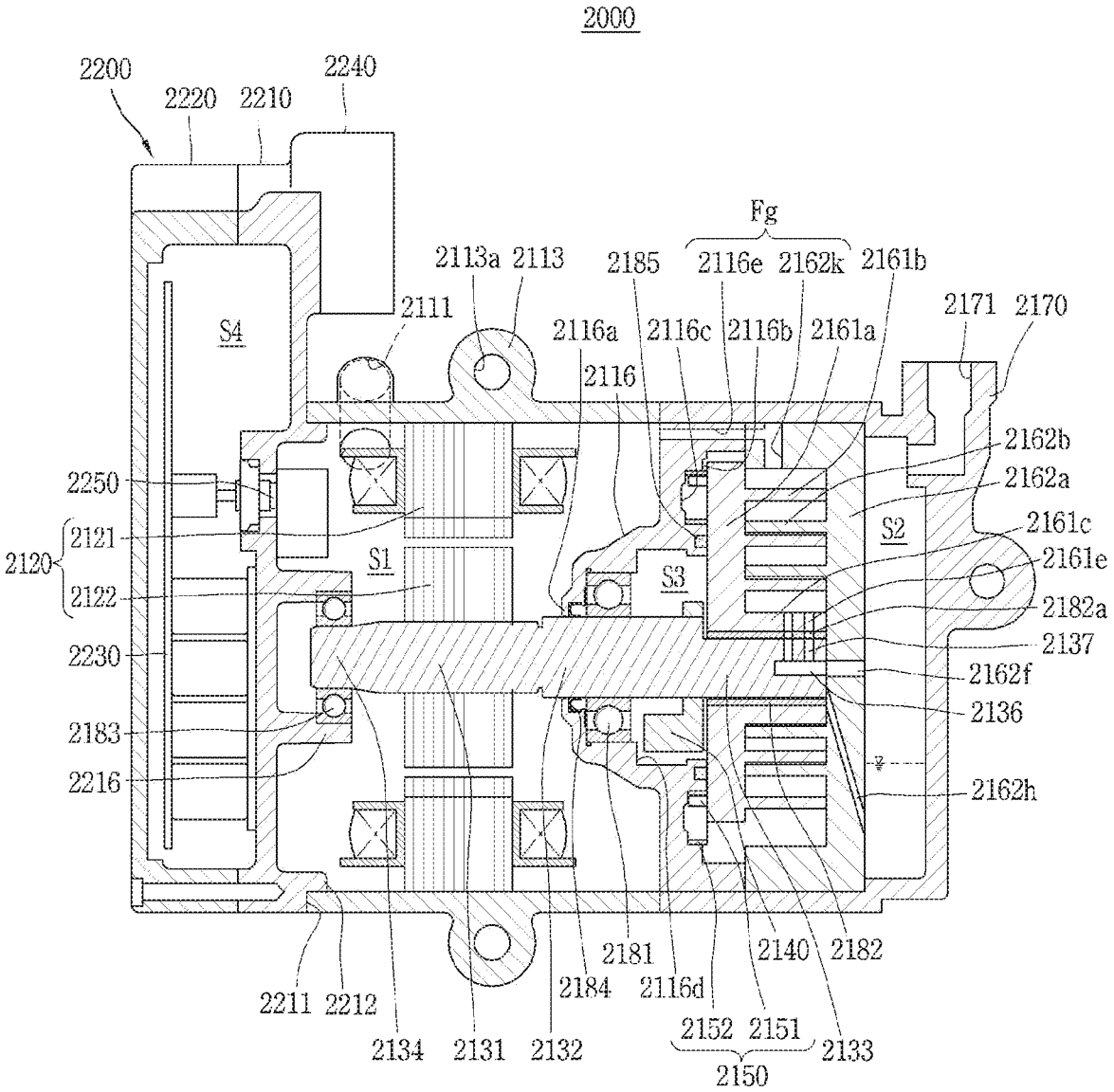
FIG. 9 is a cross-sectional view of a motor operated compressor for explaining an application example of the present disclosure.

FIG. 9 is a cross-sectional view of a motor operated compressor 2000 for explaining an application example of the present disclosure.

The appearance of a compressor module 2100 is formed by a main housing 2110 and a rear housing 2170. A drive motor 2120, a main frame 2116, a first scroll 2161 and a second housing 2162 are mounted in a space defined by the main housing 2110 and the rear housing 2170.

The main housing 2110 and the main frame 2116 may be formed as separate members. The main frame 2116 may be fixed to an inner circumferential surface of the main housing 2110.

A rotary shaft 2130 may be supported at two points in a radial direction by a main bearing 2181 and a sub bearing 2183.

The main bearing 2181 is mounted on the main frame 2116. The main bearing 2181 surrounds an outer circumferential surface of the rotary shaft 2130 to support the rotary shaft 2130 in a radial direction.

A sealing member 2184 for preventing fluid leakage from the back pressure chamber (S3) is provided on a front side of the main bearing 2181. The sealing member 2184 is formed in an annular shape, and has a horseshoe-shaped cross section so as to be elastically deformable.

The sub bearing 2183 also surrounds an outer circumferential surface of the rotary shaft 2130 to support the rotary shaft 2130 in a radial direction. The sub bearing 2183 is disposed on a front side relative to the main bearing 2181. A sub bearing support portion 2216 is protruded from one side of the inverter housing 2210, and the sub bearing 2183 is mounted on the sub bearing support portion 2216.

The rotation prevention mechanism 2150 is formed of a pin 2151 and a ring 2152. The ring 2152 is mounted on the rotation prevention mechanism mounting groove 2116*c* of the main frame 2116. The pin 2151 is protruded from the ring 2152 toward an orbiting disk portion 2161*a* of the first scroll 2161.

Another sealing member 2185 is provided between the back pressure chamber (S3) and the rotation prevention mechanism 2150. The sealing member 2185 is disposed between the first scroll 2161 and the main frame 2116. The sealing member 2185 may be brought into close contact with the orbiting disk portion 2161*a* of the first scroll 2161 by a pressure supplied from the back pressure chamber (S3).

An oil guide passage 2162*h* is formed to pass through the orbiting disk portion 2161*a* of the second scroll 2162. The oil guide passage 2162*h* is formed to guide oil stored in the oil separation chamber (S2) to a bearing surface of the rotary shaft 2130.

The rotary shaft 2130 includes a drive motor coupling portion 2131, a main bearing portion 2132, an eccentric portion 2133, and a sub bearing portion 2134. The rotary shaft 2130 passes through the first scroll 2161, and extends to a position facing the orbiting disk portion 2161*a* of the second scroll 2162. An end portion of the eccentric portion 2133 is disposed to face the orbiting disk portion 2161*a*.

The suction passage (Fg) for supplying fluid to the compression unit is formed by a first passage 3116*e* of the main frame 3116 and a second passage 3162*k* of the second scroll 3162. The first passage 3116*e* passes through the main frame 3116 in an axial direction. One end of the second passage 3162*k* is connected to the first passage 3116*e* and the other end of the second passage 3162*k* is connected to the compression chamber (V).

A discharge passage is formed by the first scroll side discharge hole 2161*e*, the bush bearing side discharge hole 2182*a*, the rotary shaft side discharge hole 2137, the hollow portion 2136, and the second scroll side discharge hole 2162*f*. The first scroll side discharge hole 2161*e* is formed in the rotary shaft coupling portion 2161*c* of the first scroll 2161. The bush bearing side discharge hole 2182*a* is formed in the bush bearing 2182. The rotary shaft side discharge hole 2137 and the hollow portion 2136 are formed in the eccentric portion 2133. The second scroll side discharge hole 2162*f* is formed in the orbiting disk portion 2161*a*.

When the motor operated compressor 2000 is operated, the rotary shaft 2130 rotates in place, and the eccentric portion 2133 rotates eccentrically with respect to the center of the rotary shaft 2130. The first scroll 2161 performs an orbiting movement by the rotation prevention mechanism 2150.

When the rotary shaft side discharge hole 2137 is located at a position facing the first scroll side discharge hole 2161*e* and the bush bearing side discharge hole 2182*a*, compressed fluid is discharged to the oil separation chamber (S2) through the discharge passage. Oil is separated from the compressed fluid and is collected in a lower section of the oil separation chamber (S2), and refrigerant is discharged through the discharge port 2171 of the rear housing 2170.

Figure 10:
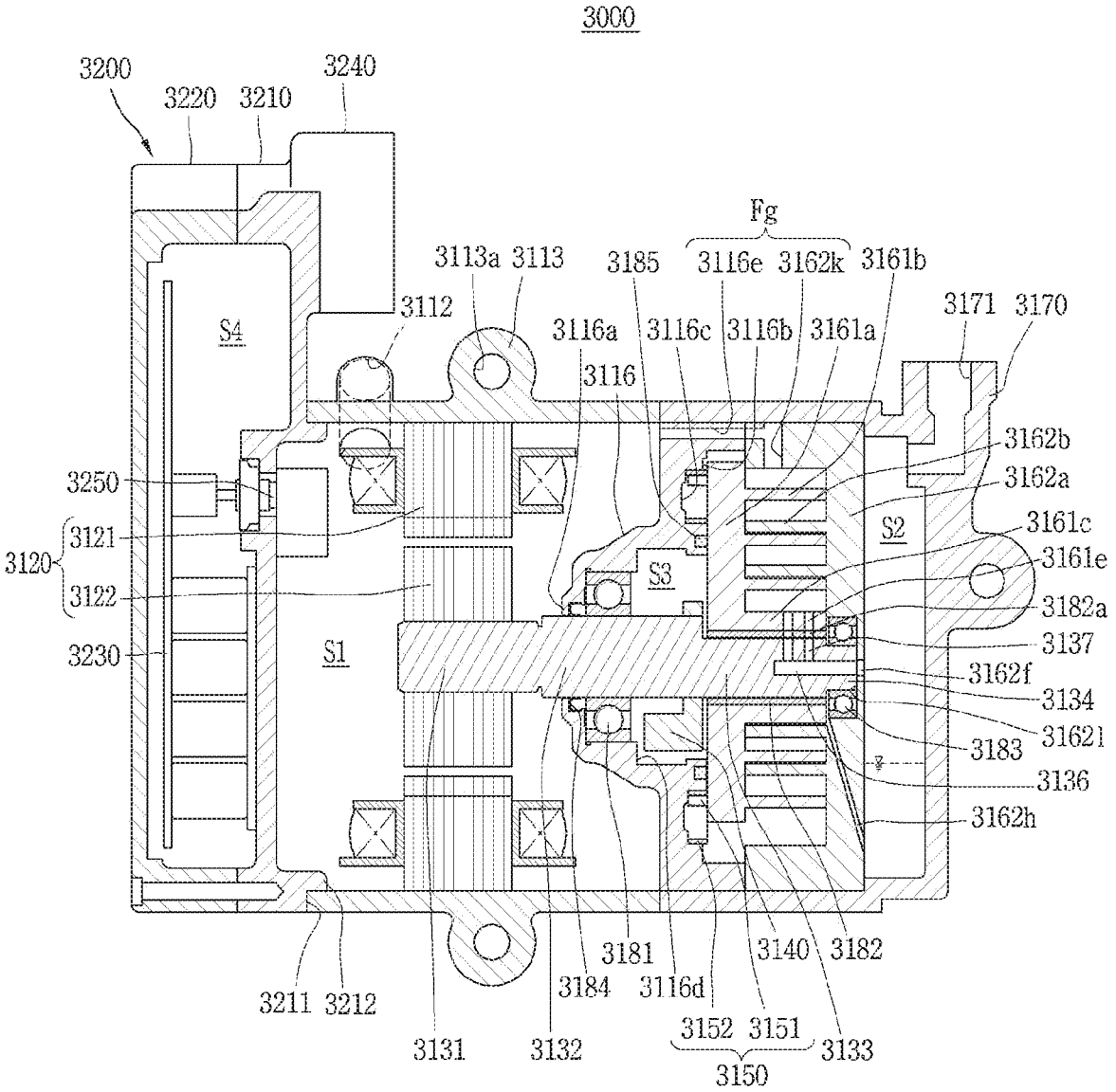
FIG. 10 is a cross-sectional view of a motor operated compressor for explaining another application example of the present disclosure.

FIG. 10 is a cross-sectional view of a motor operated compressor 3000 for explaining another application example of the present disclosure.

A rotary shaft 3130 may be supported at two points in a radial direction by a main bearing 3181 and a sub bearing 3183.

The main bearing 3181 is mounted on the main frame 3116. The main bearing 3181 surrounds an outer circumferential surface of the rotary shaft 3130 to support the rotary shaft 3130 in a radial direction.

The sub bearing 3183 also surrounds an outer circumferential surface of the rotary shaft 3130 to support the rotary shaft 3130 in a radial direction. The sub bearing 3183 is disposed on a rear side relative to the main bearing 3181. The second scroll 3162 includes a rotary shaft receiving portion 31621, and the rotary shaft receiving portion 31621 is formed to be recessed from the fixed disk portion 3162*a* toward the rear housing 3170. The sub bearing portion 3134 of the rotary shaft 3130 is inserted into the rotary shaft receiving portion 31621, and the sub bearing 3183 is coupled to a circumference of the sub bearing portion 3134 inserted into the rotary shaft receiving portion 31621.

An oil guide passage 3162*h* is formed to pass through the orbiting disk portion 3161*a* of the second scroll 3162. The oil guide passage 3162*h* is formed to guide oil stored in the oil separation chamber (S2) to a bearing surface of the rotary shaft 3130.

The rotary shaft 3130 includes a drive motor coupling portion 3131, a main bearing portion 3132, an eccentric portion 3133, and a sub bearing portion 3134. The rotary shaft 3130 passes through the first scroll 3161, and is inserted into the rotary shaft receiving portion 31621 of the second scroll 3162. The sub bearing portion 3134 is disposed to face the second scroll 3162.

A discharge passage is formed by the first scroll side discharge hole 3161*e*, the bush bearing side discharge hole 3182*a*, the rotary shaft side discharge hole 3137, the hollow portion 3136, and the second scroll side discharge hole 3162*f*. The first scroll side discharge hole 3161*e* is formed in the rotary shaft coupling portion 3161*c* of the first scroll 3161. The bush bearing side discharge hole 3182*a* is formed in the bush bearing 3182. The rotary shaft side discharge hole 3137 is formed in the eccentric portion 3133. The hollow portion 3136 is formed in the eccentric portion 3133 and the sub bearing portion 3134. The second scroll side discharge hole 3162*f* is formed in the orbiting disk portion 3161*a* or the rotary shaft receiving portion 31621.

When the motor operated compressor 3000 is operated, the rotary shaft 3130 rotates in place, and the eccentric portion 3133 rotates eccentrically with respect to the center of the rotary shaft 3130. The first scroll 3161 performs an orbiting movement by the rotation prevention mechanism 3150.

When the rotary shaft side discharge hole 3137 is located at a position facing the first scroll side discharge hole 3161*e* and the bush bearing side discharge hole 3182*a*, compressed fluid is discharged to the oil separation chamber (S2) through the discharge passage. Oil is separated from the compressed fluid and is collected in a lower section of the oil separation chamber (S2), and refrigerant is discharged through the discharge port 3171 of the rear housing 3170.

Figure 11:
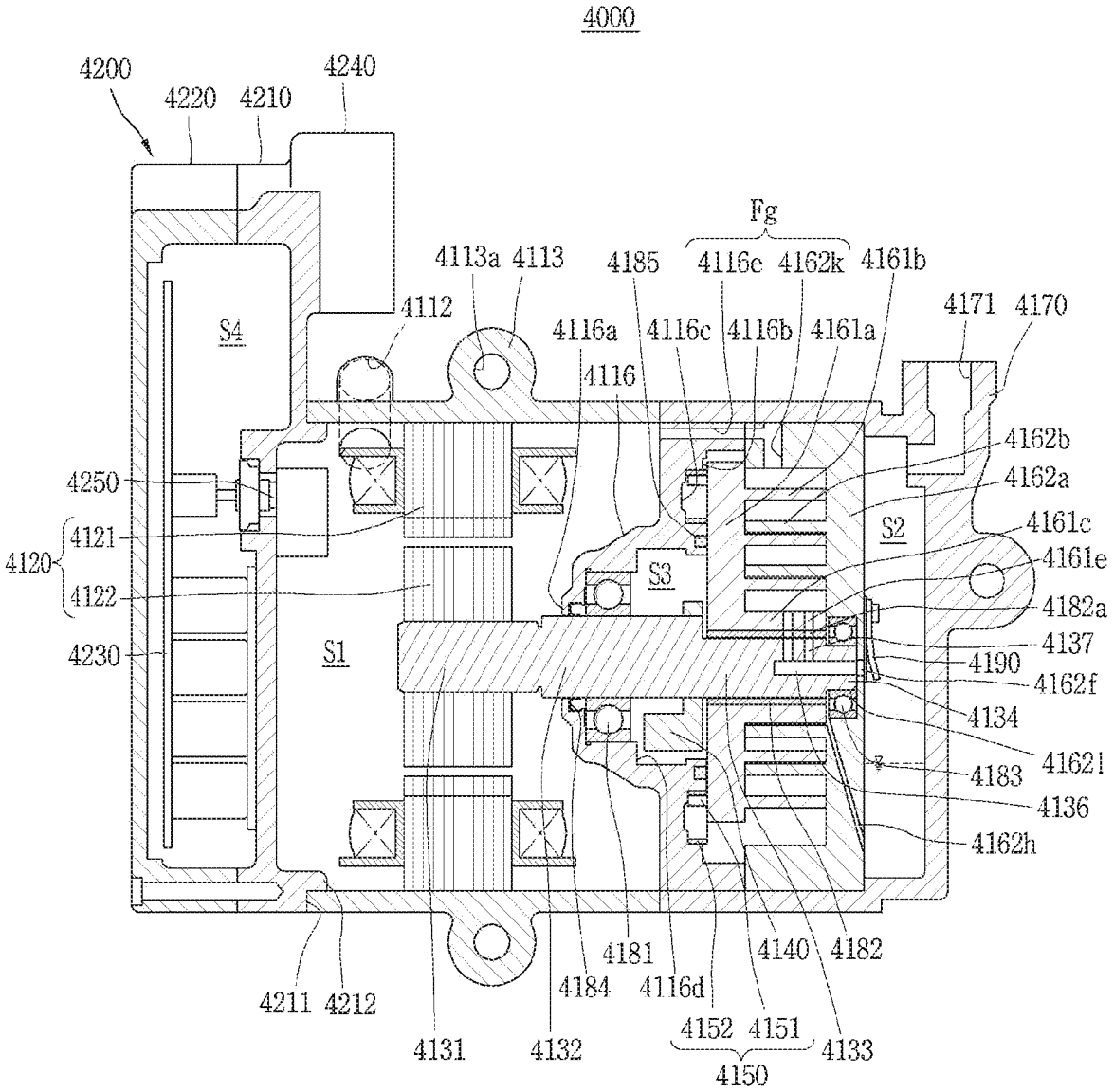
FIG. 11 is a cross-sectional view of a motor operated compressor for explaining still another application example of the present disclosure.

FIG. 11 is a cross-sectional view of a motor operated compressor 4000 for explaining still another application example of the present disclosure.

In the motor operated compressor 4000, the closing and opening of the discharge passage are periodically repeated by the rotation of the rotary shaft 4130. Therefore, the discharge valve is not necessarily required. However, when fluid is compressed at a very high pressure, a discharge valve may be provided as necessary to prevent the leakage of the fluid.

When a surface on which the fixed wrap 4162*b* is formed in the second scroll 4162 is referred to as a first surface and a surface opposite thereto is referred to as a second surface, the discharge valve 4190 may be provided on the second surface. The discharge valve 4190 is formed to open and close the second scroll side discharge hole 4162*f*. The discharge valve 4190 may be formed to be open above a reference pressure.

When the motor operated compressor 4000 is operated, the rotary shaft 4130 rotates in place, and the eccentric portion 4133 rotates eccentrically with respect to the center of the rotary shaft 4130. The first scroll 4161 performs an orbiting movement by the rotation prevention mechanism.

When the rotary shaft side discharge hole 4137 is located at a position facing the first scroll side discharge hole 4161*e* and the bush bearing side discharge hole 4182*a*, the discharge valve is open by compressed fluid. Furthermore, the compressed fluid is discharged into the oil separation chamber (S2) through the discharge passage. Oil is separated from the compressed fluid and is collected in a lower section of the oil separation chamber (S2), and refrigerant is discharged through the discharge port 4171 of the rear housing 4170.

According to the present disclosure, a simple passage structure capable of discharging high-pressure refrigerant through the hollow portion of the rotary shaft may be implemented. A flow resistance of compressed fluid may be relaxed by the simple passage structure, and the reduction of compression efficiency may be prevented.

Furthermore, in the present disclosure, the closing and opening of the discharging passage is carried out periodically in accordance with the rotation of the rotary shaft. Accordingly, reverse flow is prevented even when the discharge valve is not provided for each discharge hole, and high-pressure refrigerant may be discharged periodically.

Furthermore, according to the present disclosure, high-pressure refrigerant may be discharged by only one discharge hole formed in the hollow portion of the rotary shaft. Therefore, the present disclosure may simplify and downsize the structure of the motor operated compressor, and provide an advantageous basis for an optimum structure design of the motor operated compressor.

The configurations and methods according to the above-described embodiments will not be limited to the foregoing motor operated compressor, and all or part of each embodiment may be selectively combined and configured to make various modifications thereto.

What is claimed is:

1. A motor operated compressor, comprising:

a drive motor having a stator and a rotor;

a rotary shaft coupled to the rotor;

a first scroll disposed on one side of the drive motor, eccentrically coupled to the rotary shaft, and orbitally moved by the rotary shaft; and a second scroll fixed at a position facing the first scroll, and coupled to the first scroll to form a compression chamber together with the first scroll, wherein the rotary shaft comprises:

a hollow portion formed inside the rotary shaft along an axial direction; and an eccentric portion including a rotary shaft side discharge hole formed eccentrically from the center of the rotary shaft, and extending from an outer circumferential surface of the rotary shaft to the hollow portion, and the first scroll including a rotary shaft coupling portion surrounding an outer circumferential surface of the eccentric portion, and the rotary shaft coupling portion including a first scroll side discharge hole formed at a position periodically facing the rotary shaft side discharge hole to discharge compressed fluid to the rotary shaft side discharge hole.

2. The motor operated compressor of claim 1, wherein the rotary shaft side discharge hole has a long hole shape in which a curve length extended along an outer circumferential surface of the eccentric portion is greater than a curve or straight-line length extended along an axial direction of the rotary shaft.

3. The motor operated compressor of claim 1, wherein an axial direction length of the rotary shaft side discharge hole is constant, and a circumferential direction width of the rotary shaft side discharge hole is formed to gradually increase from an inner circumferential surface of the hollow portion to an outer circumferential surface of the eccentric portion.

4. The motor operated compressor of claim 1, wherein a cross section of the rotary shaft side discharge hole has an annulus sector shape obtained by subtracting a smaller one from a larger one of two sectors having the same origin and the same central angle.

5. The motor operated compressor of claim 1, wherein the eccentric portion comprises:

a first portion having a relatively large thickness in a radial direction of the eccentric portion; and a second portion formed on both sides of the first portion to have a relatively small thickness in a radial direction of the eccentric portion, and the rotary shaft side discharge hole is formed in the first portion.

6. The motor operated compressor of claim 1, wherein when a reference point of a portion having the largest thickness in the eccentric portion with respect to the center of the rotary shaft is defined as 0° which is a reference of a circle coordinate, the rotary shaft side discharge hole is formed at an angle in a range of −60° to +60°.

7. The motor operated compressor of claim 1, wherein at least one of the rotary shaft side discharge hole and the first scroll side discharge hole includes a plurality of discharge holes, and when the rotary shaft side discharge hole includes the plurality of discharge holes, the plurality of discharge holes are formed at positions spaced apart from each other along an axial direction of the rotary shaft or formed at positions spaced apart from each other in a direction intersecting the axial direction along an outer circumferential surface of the eccentric portion, and when the first scroll side discharge holes include the plurality of discharge holes, the plurality of discharge holes are formed at positions spaced apart from each other along an axial direction of the rotary shaft or formed at positions spaced apart from each other in a direction intersecting the axial direction along an inner circumferential surface of the rotary shaft coupling portion.

8. The motor operated compressor of claim 1, wherein the first scroll comprises:

a plate shaped disk portion; and a wrap protruding from the disk portion toward the second scroll along an involute shape, and the rotary shaft coupling portion is formed at a position corresponding to a base circle in the involute shape, and the first scroll side discharge hole is formed at a portion having the smallest radial direction thickness in the rotary shaft coupling portion.

9. The motor operated compressor of claim 1, wherein a size of the first scroll side discharge hole is smaller than that of the rotary shaft side discharge hole, and a circumferential direction width of the first scroll side discharge hole is smaller than that of the rotary shaft side discharge hole.

10. The motor operated compressor of claim 1, further comprising:

a bush bearing formed to surround the eccentric portion, wherein the bush bearing is disposed between the eccentric portion and the rotary shaft coupling portion, and provided with a bush bearing side discharge hole formed at a position facing the first scroll side discharge hole, and a relative position between the rotary shaft coupling portion and the bush bearing is fixed to maintain a state in which the first scroll side discharge hole and the bush bearing side discharge hole face each other.

11. The motor operated compressor of claim 1, wherein the second scroll is disposed to face one end of the rotary shaft, and the second scroll is provided with a second scroll side discharge hole at a position facing the hollow portion.

12. The motor operated compressor of claim 11, wherein the second scroll has a shaft receiving portion, the shaft receiving portion being recessed on one surface of the second scroll to accommodate one end of the rotary shaft, the rotary shaft is inserted into the shaft receiving portion through the first scroll, and the second scroll side discharge hole is formed in the shaft receiving portion.

13. The motor operated compressor of claim 11, further comprising:

a discharge valve formed to open and close the second scroll side discharge hole, wherein the discharge valve is configured to open above a reference pressure.

14. The motor operated compressor of claim 11, further comprising:

a rear housing, wherein the rear housing is coupled to the second scroll to form an oil separation chamber that accommodates fluid discharged through the second scroll side discharge hole, and the second scroll comprises:

a plate shaped disk portion; and an oil guide passage extending through the disk portion to supply oil stored in the oil separation chamber to an outer circumferential surface of the rotary shaft.

15. The motor operated compressor of claim 11, further comprising:

a main frame formed to support the first scroll, wherein the main frame, the first scroll, and the second scroll are sequentially arranged along an axial direction away from the drive motor, and the rotary shaft extends to a position facing a disk portion of the second scroll through the main frame and the first scroll, and the second scroll side discharge hole is formed in the disk portion.

* * * * *